US007696475B2

(12) United States Patent
Shiea et al.

(10) Patent No.: US 7,696,475 B2
(45) Date of Patent: Apr. 13, 2010

(54) ELECTROSPRAY-ASSISTED LASER DESORPTION IONIZATION DEVICE, MASS SPECTROMETER, AND METHOD FOR MASS SPECTROMETRY

(75) Inventors: Jentaie Shiea, Kaohsiung (TW); Min Zong Huang, Kaohsiung (TW)

(73) Assignee: National Sun Yat-Sen University, Kaohsiung (TW)

( * ) Notice: Subject to any disclaimer, the term of this patent is extended or adjusted under 35 U.S.C. 154(b) by 214 days.

(21) Appl. No.: 11/561,131

(22) Filed: Nov. 17, 2006

(65) Prior Publication Data

US 2007/0176113 A1 Aug. 2, 2007

(30) Foreign Application Priority Data

Jan. 27, 2006 (TW) ..... 95103439 A

(51) Int. Cl.
*H01J 49/10* (2006.01)

(52) U.S. Cl. ..... 250/288; 250/281; 250/282; 250/286; 250/287; 250/425; 435/287.1; 435/287.2; 239/418

(58) Field of Classification Search ..... 250/281, 250/282, 286, 287, 288, 423 R, 424, 425, 250/423 P; 435/287.1, 287.2; 239/418
See application file for complete search history.

(56) References Cited

U.S. PATENT DOCUMENTS 5,663,561 A 9/1997 Franzen et al.
5,873,523 A * 2/1999 Gomez et al. ..... 239/3
6,485,689 B1 * 11/2002 Huang et al. ..... 422/83
6,838,663 B2 * 1/2005 Coon et al. ..... 250/288
7,193,223 B2 3/2007 Franzen
2002/0127566 A1 * 9/2002 Hirabayashi et al. ..... 435/6
2006/0186332 A1 * 8/2006 Haase et al. ..... 250/288
2008/0116366 A1 * 5/2008 Shiea et al. ..... 250/282

OTHER PUBLICATIONS

Shiea, et al ("Electrospray-assisted laser desorption/ionization mass spectrometry for direct ambient analysis of solids" Rapid Communications in Mass Spectrometry, vol. 19, issue 24, Dec. 30, 2005 pp. 3701-3704).*

* cited by examiner

*Primary Examiner*—David A Vanore
*Assistant Examiner*—Michael Maskell
(74) *Attorney, Agent, or Firm*—Stephen A. Bent; Foley & Lardner LLP

(57) ABSTRACT

An electrospray-assisted laser desorption ionization device includes: an electrospray unit including a nozzle; a voltage supplying member disposed to establish between the nozzle and a receiving unit a potential difference such that liquid drops of the electrospray medium formed at the nozzle are laden with charges, and such that the liquid drops are forced to leave the nozzle toward the receiving unit along a traveling path; a laser desorption unit adapted to irradiate a sample such that, upon irradiation, analytes contained in the sample are desorbed to fly along a flying path which intersects the traveling path so as to enable the analytes to be occluded in the liquid drops, and such that as a result of dwindling in size of the liquid drops when moving along the traveling path, charges of the liquid drops will pass on to the analytes occluded therein to form ionized analytes.

18 Claims, 13 Drawing Sheets

ELECTROSPRAY-ASSISTED LASER DESORPTION IONIZATION DEVICE, MASS SPECTROMETER, AND METHOD FOR MASS SPECTROMETRY

CROSS-REFERENCE TO RELATED APPLICATION

This application claims priority of Taiwanese Application No. 095103439, filed on Jan. 27, 2006.

BACKGROUND OF THE INVENTION

1. Field of the Invention

The invention relates to an ionization device, more particularly to an electrospray-assisted laser desorption ionization device, which is adapted for use with a mass analyzer and a detector for conducting direct analysis of mass spectrometry on a sample (in particular a biochemical sample), and for obtaining mass spectrometric analysis information on macromolecules such as protein molecules. The present invention also relates to a mass spectrometer utilizing the electrospray-assisted laser desorption ionization device, and a method for mass spectrometry.

2. Description of the Related Art

Laser desorption mass spectrometer performs laser desorption (LD) by utilizing a transmission mechanism that is capable of transmitting laser beams in a vacuum environment. In other words, by irradiating laser beams at the surface of a tissue section, the protein molecules at the site of impact absorb the energy of the laser beams to thereby directly desorb from the surface of the tissue section in the form of ions carrying electric charges. Mass spectrometric analysis is then performed by a mass analyzer. For relevant techniques, please refer to the following article: Tabet, J. C., Cotter, R. J. Anal. Chem. 1984; 56, 1662. It is widely recognized that among the analytes desorbed by the laser beams, the number of neutral analytes far exceeds the number of ionized analytes; that is, ionization efficiency is extremely low. The signal resulted from this extremely low ratio of ionized analytes is too small and is therefore easily interfered by noise signals. At the same time, detection sensitivity and reconstruction ability of the signals are poor such that results of the mass spectrometric analysis is relatively less objective, and is therefore hardly determinative.

Another type of ionization method is electrospray ionization (ESI), which involves extraction of proteins from a tissue section for obtaining a protein solution, followed by a protein analysis conducted by an electrospray ionization mass spectrometer (ESI-MS) 1 including an electrospray ionization device 11 as illustrated in FIG. 1. For relevant technology, please refer to the following article: *Yamashita, M., Fenn, J. B. J. Phys. Chem.* 1984; 08, 4451.

The electrospray ionization device 11 of the electrospray ionization mass spectrometer 1 performs an electrospray ionization procedure to ionize the proteins in the protein solution. The electrospray ionization device 11 includes a capillary 112 having an open end 111 that opens toward an entrance side 121 of a mass analyzer 12 included in the electrospray ionization mass spectrometer 1. When in use, an electric field, for instance, a 2-5 kV voltage difference, is established between the open end 111 of the capillary 112 and the entrance side 121 of the mass analyzer 12. Subsequently, the protein solution is pushed through the capillary 112 toward the open end 111. The protein solution forms a Taylor cone 2 that is filled with electric charges as it passes through the open end 111 of the capillary 112 due to the combined effect of the electric field present between the open end 111 of the capillary 112 and the entrance side 121 of the mass analyzer 12 and the surface tension of the protein solution at the open end 111. As the electric field force overcomes the surface tension of the protein solution at the open end 111 of the capillary 112, aerosol droplets containing multivalent electric charges and protein molecules are formed, and are pushed into the mass analyzer 12 through the entrance side 121 thereof.

As the charged droplets travel through the air from the open end 111 of the capillary 112 toward the entrance side 121 of the mass analyzer 12, the liquid portion of the charged droplets vaporize such that the charged droplets dwindle in size, causing the multivalent electrons to attach to the protein molecules to form ionized protein molecules with relatively lower m/z values (i.e., the mass-to-charge ratio, where m is the mass of the ionized molecule, and z is the ionic charge/number of elementary charges). Since the molecular weight of a macromolecule, such as a protein molecule, is in the hundreds of thousands, charges attached to each of the macromolecules for forming the ionized molecules needs to be multivalent in order for the m/z value to be low enough so as to be detectable by the mass analyzer 12. Not only does the electrospray ionization method allow macromolecules to be efficiently ionized, but it also overcomes the detection limit imposed by the mass analyzer 12 since a lower m/z value can be obtained. Therefore, protein molecules can be studied using electrospray ionization mass spectrometry.

Although the electrospray ionization mass spectrometer 1 as illustrated in FIG. 1 is capable of conducting mass spectrometric analysis on proteins, the sample used for the analysis can only be in a solution form. Therefore, for a tissue section, mass spectrometry can only be conducted after a series of tedious sample preparation procedures, such as the extraction of proteins and the formation of the protein solution, have been completed. This sample preparation process is time consuming. In addition, detailed spatial analysis of the sample can only be performed if an extremely small voluminal tissue section is sampled and analyzed multiple times using electrospray ionization mass spectrometry.

It can be seen from the above that conducting protein analysis directly on a tissue section using mass spectrometry techniques presents a variety of difficulties and inconveniences. Since spatial analytic information of proteins in organs or tissues is extremely important in medical and biotechnological fields, there exists a great need for a method of mass spectrometry that is capable of conducting rapid, convenient, and accurate protein analysis on a particular portion on an "unprocessed" tissue section (i.e., a tissue section without sample preparation).

SUMMARY OF THE INVENTION

Therefore, the object of the present invention is to provide an ionization device, a mass spectrometer, and a method for mass spectrometry that are capable of overcoming the aforesaid drawbacks associated with the prior art.

According to one aspect of the present invention, there is provided an electrospray-assisted laser desorption ionization device that is adapted for use in a mass spectrometer. The mass spectrometer includes a receiving unit disposed to admit therein ionized analytes that are derived from a sample, and that are to be analyzed by the mass spectrometer. The electrospray-assisted laser desorption ionization device includes an electrospray unit, a voltage supplying member, and a laser desorption unit.

The electrospray unit includes a reservoir for accommodating a liquid electrospray medium, and a nozzle which is disposed downstream of the reservoir, and which is configured to sequentially form liquid drops of the electrospray medium thereat. The nozzle is adapted to be spaced apart from the receiving unit in a longitudinal direction so as to define a traveling path.

The voltage supplying member is disposed to establish between the nozzle and the receiving unit a potential difference which is of an intensity such that the liquid drops are laden with a plurality of charges, and such that the liquid drops are forced to leave the nozzle as multiple-charged ones for heading toward the receiving unit along the traveling path.

The laser desorption unit is adapted to irradiate the sample such that, upon irradiation, at least one of the analytes contained in the sample is desorbed to fly along a flying path which intersects the traveling path so as to enable said at least one of the analytes to be occluded in the multiple-charged liquid drops, and such that as a result of dwindling in size of the multiple-charged liquid drops when approaching the receiving unit along the traveling path, charges of the liquid drops will pass on to said at least one of the analytes occluded therein to form a corresponding one of the ionized analytes.

According to another aspect of the present invention, there is provided a mass spectrometer that includes a receiving unit and an electrospray-assisted laser desorption ionization device.

The receiving unit is disposed to admit therein ionized analytes that are derived from a sample, and that are to be analyzed by the mass spectrometer.

The electrospray-assisted laser desorption ionization device includes an electrospray unit, a voltage supplying member, and a laser desorption unit. The electrospray unit includes a reservoir for accommodating a liquid electrospray medium, and a nozzle which is disposed downstream of the reservoir, and which is configured to sequentially form liquid drops of the electrospray medium thereat. The nozzle is spaced apart from the receiving unit in a longitudinal direction so as to define a traveling path. The voltage supplying member is disposed to establish between the nozzle and the receiving unit a potential difference which is of an intensity such that the liquid drops are laden with a plurality of charges, and such that the liquid drops are forced to leave the nozzle as multiple-charged ones for heading toward the receiving unit along the traveling path. The laser desorption unit is adapted to irradiate the sample such that, upon irradiation, at least one of the analytes contained in the sample is desorbed to fly along a flying path which intersects the traveling path so as to enable said at least one of the analytes to be occluded in the multiple-charged liquid drops, and such that as a result of dwindling in size of the multiple-charged liquid drops when approaching the receiving unit along the traveling path, charges of the liquid drops will pass on to said at least one of the analytes occluded therein to form a corresponding one of the ionized analytes.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
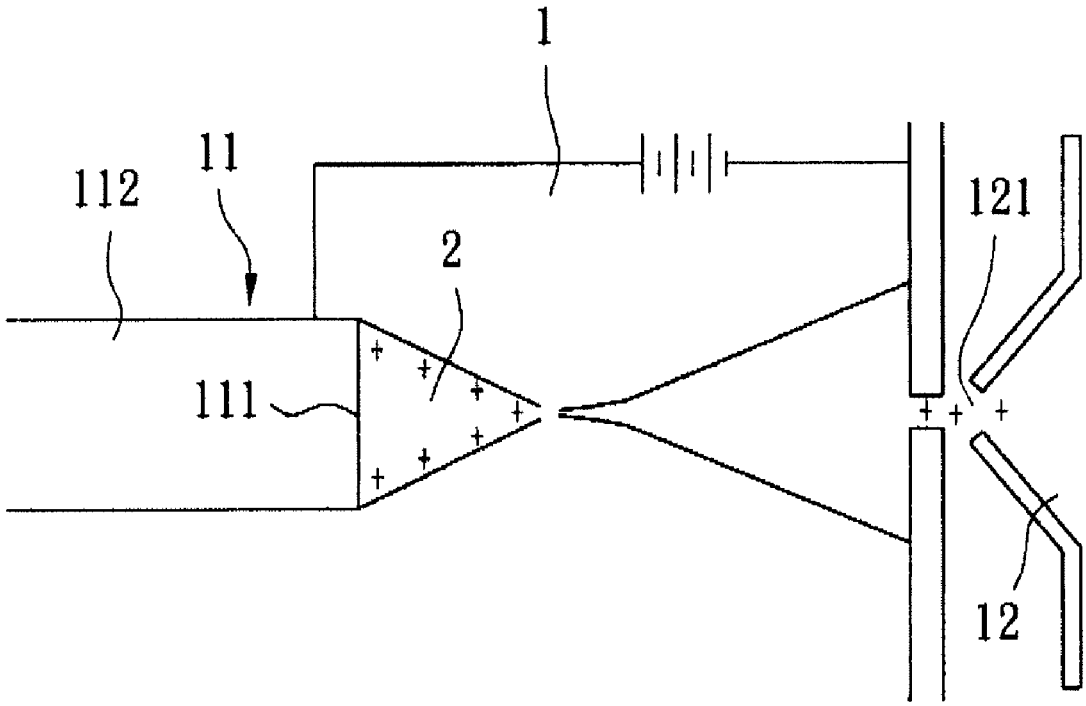
FIG. 1 PRIOR ART
FIG. 1 is a schematic diagram of various components included in an electrospray ionization mass spectrometer (ESI-MS) of the prior art to illustrate relative positions of the components and operational method involved in the ESI-MS.

Before the present invention is described in greater detail, it should be noted herein that like elements are denoted by the same reference numerals throughout the disclosure.

The applicant of the present invention tried to incorporate, under atmospheric pressure, the abovementioned "laser desorption" (LD) technique, which requires to be conducted in vacuum, and the previously described "electrospray ionization" (ESI) technique, which requires preparation of solution samples, and then conduct detection directly on various kinds of solid samples. Surprisingly, the obtained mass spectrometric analysis results established that this novel ionization technique, referred to as electrospray-assisted laser desorption ionization (ELDI), is practicable, wherein the limitation imposed on the operational condition of laser desorption (i.e., in vacuum) is no longer required, and the sample preparation necessary for electrospray ionization is also eliminated. Therefore, through the electrospray-assisted laser desorption ionization technique, satisfactory analytic results can be obtained under atmospheric pressure on a solid sample.

Figure 2:
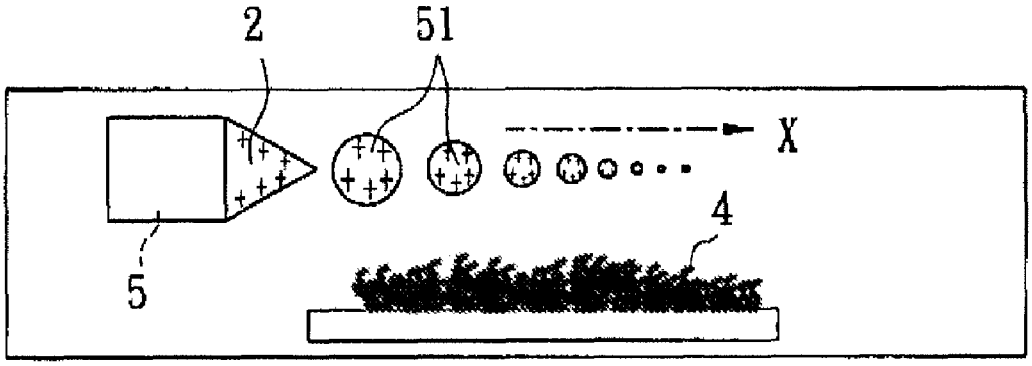
FIG. 2 is a schematic diagram, illustrating multiple-charged liquid drops leaving a nozzle along a traveling path.
Figure 3:
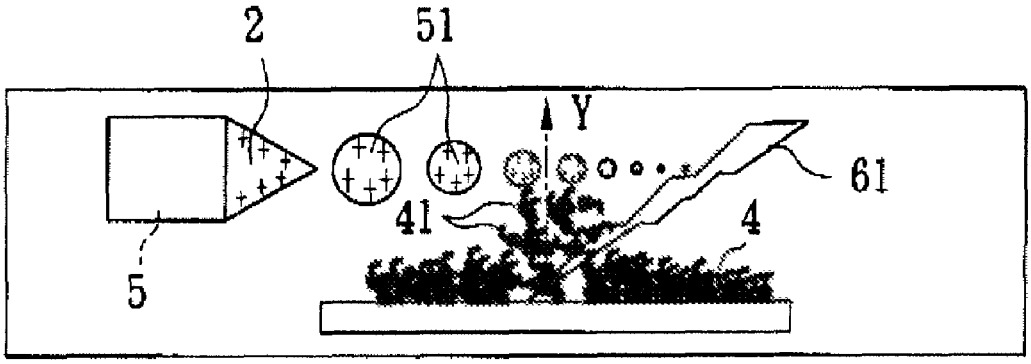
FIG. 3 is a schematic diagram, illustrating desorption of analytes contained in a sample so as to fly along a flying path that intersects the traveling path of the multiple-charged liquid drops.
Figure 4:
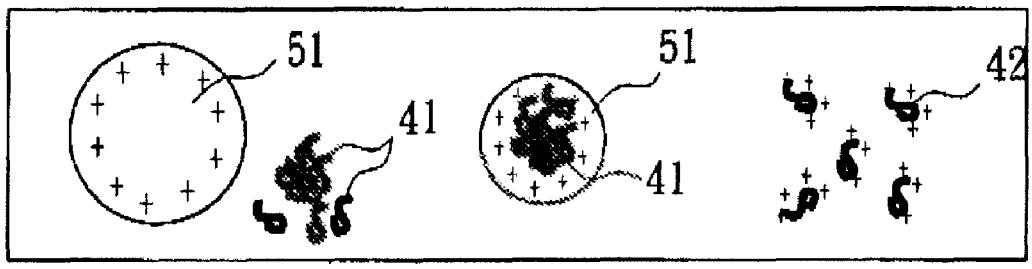
FIG. 4 is a schematic diagram, illustrating occlusion of the analytes in the multiple-charged liquid drops, and formation of ionized analytes as a result of dwindling in size of the multiple-charged liquid drops having the analytes occluded therein.

As shown in FIGS. 2 to 4, the applicant of the present invention assumed that a possible mechanism for employing electrospray-assisted laser desorption ionization is as follows:

As shown in FIG. 2, a solid sample 4 and a nozzle 73 for ejecting an electrospray medium 5 need to be prepared prior to operation of electrospray-assisted laser desorption ionization. Under a potential difference, the electrospray medium 5 forms a Taylor cone 2 that is filled with a plurality of electric charges (positive charges in this case) at the tip of the nozzle 73. As the electric field force due to the potential difference overcomes the surface tension of the electrospray medium 5 at the tip of the nozzle 73, multiple-charged liquid drops 51 are formed at the tip of the nozzle 73 sequentially to move along a traveling path (toward the mass analyzer). On the other hand, as shown in FIG. 3, under atmospheric pressure, a laser beam 61 is irradiated on the solid sample 4 (note that no pre-analysis preparations have been conducted on the solid sample 4) to desorb a plurality of analytes 41 contained in the solid sample 4 such that the desorbed analytes 41 fly along a flying path that intersects the traveling path. Subsequently, as shown in FIG. 4, at least one of the desorbed analytes 41 is occluded in the multiple-charged liquid drops 51. As a result of dwindling in size of the multiple-charged liquid drops 51 when moving along the traveling path due to vaporization, the charge concentration of the multiple-charged liquid drops 51 increases. Consequently, charges of the liquid drops 51 pass on to the analytes 41 occluded there into form ionized analytes 42. These ionized analytes 42 then enters a mass analyzer (not shown) for performing subsequent mass spectrometric analysis.

This novel electrospray-assisted laser desorption ionization technique is not only operable under atmospheric pressure, but also enables attachment of charges to the analytes 41 so as to form the ionized analytes 42 necessary for performing subsequent mass spectrometric analysis. Further, it has been verified via experimentation that this electrospray-assisted laser desorption ionization technique is capable of detecting a particular portion on a tissue section to successfully combine macromolecules (such as proteins) with a single or multiple electric charges so as to obtain satisfactory mass spectrometric analysis results. In particular, since this technique maintains the feature of generating liquid drops with multivalent charges present in the electrospray-assisted ionization technique, most of the ionized analytes acquired are multivalent. Therefore, the range of molecular weights detectable by employing the electrospray-assisted laser desorption ionization technique of the present invention is extensive.

Hence, with reference to information recorded in relevant databases, etc., the results generated by an electrospray-assisted laser desorption ionization mass spectrometer (ELDI-MS) that employs the ELDI technique can be used to conduct protein identification. In addition, it can be expected that the protein spatial distribution profile of an organ or a tissue can be obtained after incorporating all the results generated by the electrospray-assisted laser desorption ionization mass spectrometer on various portions on a tissue section sample.

Refer to FIGS. 2 to 5, the method for mass spectrometry employing the electrospray-assisted laser desorption ionization technique according to the present invention can be implemented by performing the following steps:

Place a proteinaceous sample 4 on a sample stage 82.

Provide an electrospray unit 71 that includes a reservoir 72 for accommodating a liquid electrospray medium 5, and a nozzle 73 which is disposed downstream of the reservoir 72, and which is configured to sequentially form liquid drops 51 of the electrospray medium 5 thereat.

Provide a mass analyzer 81 that is spaced apart from the nozzle 73 of the electrospray unit 7 for receiving and analyzing ionized analytes 42 derived from the proteinaceous sample 4.

Provide a detector 83 for detecting signals generated as a result of analyzing the ionized analytes 42 by the mass analyzer 81, and for generating a mass spectrum from the signals.

Establish between the nozzle 73 of the electrospray unit 71 and the mass analyzer 81 a potential difference which is of an intensity such that the liquid drops 51 are laden with a plurality of electric charges, and such that the liquid drops 51 are forced to leave the nozzle 73 as multiple-charged ones for heading toward the mass analyzer 81 along a traveling path (X).

Irradiate the proteinaceous sample 4 with a laser beam 61 such that at least one of the analytes 41 contained in the proteinaceous sample 4 is desorbed to fly along a flying path (Y) which intersects the traveling path (X) so as to enable said at least one of the analytes 41 to be occluded in the multiple-charged liquid drops 51, and such that as a result of dwindling in size of the multiple-charged liquid drops 51 when approaching the mass analyzer 81 along the traveling path (X), charges of the liquid drops 51 will pass on to said at least one of the analytes 41 to form a corresponding one of the ionized analytes 42.

Herein, the polarity of the electric charges carried by the liquid drops 51 depends on the electric field direction established by the potential difference present between the nozzle 73 of the electrospray unit 71 and the mass analyzer 81. In the example illustrated in FIGS. 2 to 4, the liquid drops 51 are laden with positive charges. In addition, the charges laden in the liquid drops 51 are mostly multivalent, but can also be univalent at times.

The electrospray medium forming the liquid drops is a solution normally used in electrospray methods, examples of which include solutions containing protons ($H^+$) or ions such as $OH^-$, etc. Since this aspect should be well known to those skilled in the art, further details of the same will be omitted herein for the sake of brevity. In general, a solution containing protons or $OH^-$ ions is used as the electrospray medium. The protons can be obtained through addition of an acid into the solution. With an electric field direction pointing away from the nozzle toward the mass analyzer, a plurality of "positively charged liquid drops" can be formed. This is the so-called "positive ion mode" electrospray ionization mass spectrometry. Conversely, the $OH^-$ ions can be added through addition of a base into the solution. With an electric field direction pointing away from the mass analyzer toward the nozzle, a plurality of "negatively charged liquid drops" can be formed. This is the so-called "negative ion mode" electrospray ionization mass spectrometry.

In order to facilitate interpretation of the mass spectra, a "positive ion mode" involving charged liquid drops that contain protons ($H^+$) is normally used for mass spectrometric analysis incorporating the electrospray technique. Thus, preferably, the electrospray medium is a solution containing an acid. More preferably, the electrospray medium is a solution containing a volatile liquid such that the liquid portion in the liquid drops can vaporize prior to the receipt of the ionized analytes by the mass analyzer so as to simplify the resultant mass spectra. Further, in order to help dissolve protein molecules and avoid interference due to an addition of salt in the volatile liquid, the volatile liquid is preferably one with a low polarity, such as isoacetonitrile, acetone, alcohol, etc. Therefore, preferably, the electrospray medium is a solution containing an acid and a volatile liquid. More preferably, the acid is an organic acid selected from the group consisting of formic acid, acetic acid, trifluroacetic acid, and a combination thereof. Still more preferably, the electrospray medium is a solution containing methanol and acetic acid. In the embodiments of the present invention, the electrospray medium is an aqueous solution containing 50 vol % methanol and 0.1 vol % acetic acid. In addition, it is presumed that the ionized analytes acquired are mostly multivalent with each electric charge contributed by a proton ($H^+$).

The main object of the method for mass spectrometry employing the electrospray-assisted laser desorption ionization technique according to the present invention aims at the detection of macroscopic molecules such as proteins. Naturally, the method can also be applied to applications for detecting micromolecular compounds like methaqualone (with a molecular weight 250.3), Sildenafil (with a molecular weight 474), and Diazpam (with a molecular weight 284), etc, as illustrated by some of the embodiments provided in this specification. The samples suitable for study by the method for mass spectrometry employing the electrospray-assisted laser desorption ionization technique of the present invention can be either solid or liquid, where solid samples, such as tissue sections, medicine tablets, or solids obtained after dehydrating a liquid material to be studied, are preferred.

When the sample is a tissue section, it can be a tissue section of an animal organ that is selected from the group consisting of a brain, a heart, a liver, a lung, a stomach, a kidney, a spleen, an intestine, and a uterus. In some embodiments of the present invention, the tissue section comes from an animal organ that is selected from the group consisting of a brain, a heart, and a liver.

When the sample is formed by dehydrating a liquid material to be studied, the liquid material can be various kinds of solutions, such as body fluids, chemical solutions, environment sampling solutions, or various eluates from liquid chromatography, etc. When the liquid material to be studied is a body fluid secreted by an organism, it can be selected from the group consisting of blood, tear, perspiration, intestinal juice, brains fluid, spinal fluid, lymph, pus, blood serum, saliva, nasal mucus, urine, and excrement. In some embodiments of the present invention, the liquid material to be studied is selected from the group consisting of blood, blood serum, and tear. When the liquid material under study is a chemical solution, it can be insulin, myoglobin, cytochrome c, or a protein solution made from a combination thereof, as illustrated in some of the embodiments disclosed herein.

The magnitude of the potential difference and the direction of the electric field established between the nozzle and the mass analyzer is set such that the electrospray medium is enabled to form into the multiple-charged liquid drops. The potential difference can be either positive or negative as is determined by the user according to the desired electric property of the multiple-charged liquid drops. The potential difference should be established with respect to the design of the mass analyzer, for example, by applying a voltage above 2 kV at the nozzle of the electrospray unit and grounding the mass analyzer, or by grounding the nozzle and applying a −3.5 kV voltage at the mass analyzer, as illustrated in the embodiments of the present invention.

Figure 5:
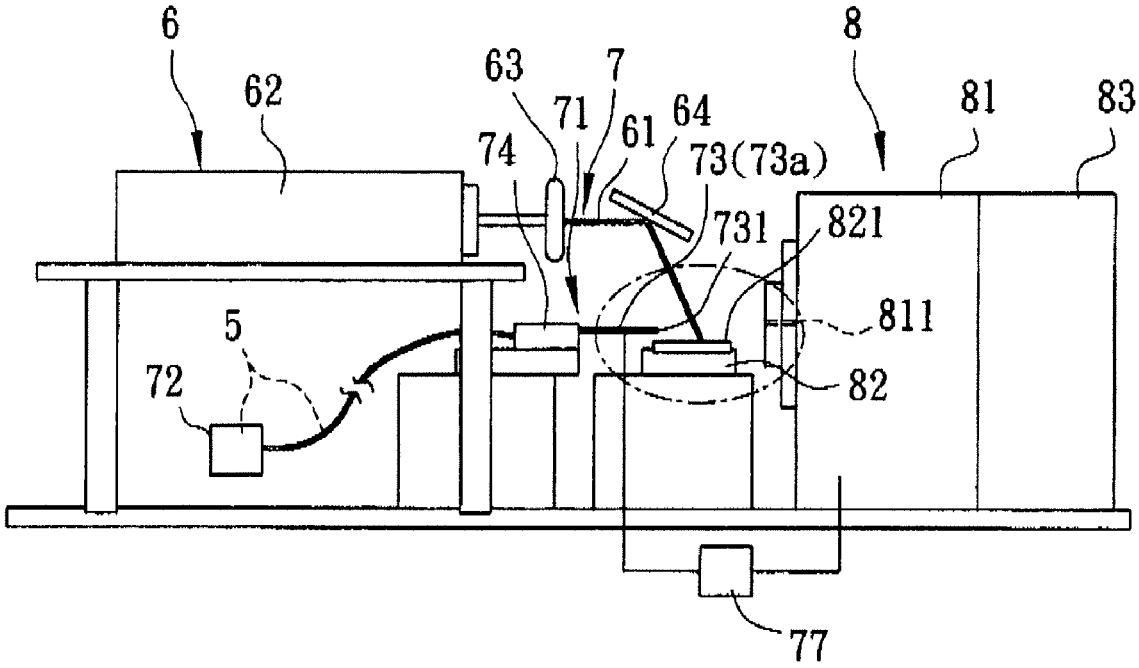
FIG. 5 is a schematic side view of a mass spectrometer incorporating the first preferred embodiment of an electrospray-assisted laser desorption ionization device according to the present invention.
Figure 6:
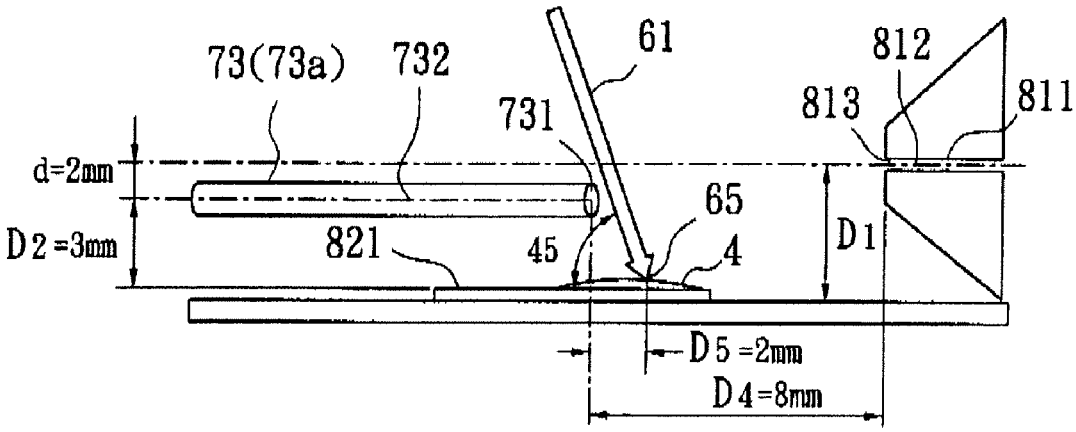
FIG. 6 is a fragmentary enlarged view of FIG. 5.

Referring to FIG. 5 and FIG. 6, an electrospray-assisted laser desorption ionization device according to the present invention is adapted for use in a mass spectrometer which includes a receiving unit disposed to admit therein ionized analytes that are derived from a sample, and that are to be analyzed by the mass spectrometer. The electrospray-assisted laser desorption ionization device includes an electrospray unit, a voltage supplying member, and a laser desorption unit.

The electrospray unit includes a reservoir for accommodating a liquid electrospray medium, and a nozzle which is disposed downstream of the reservoir, and which is configured to sequentially form liquid drops of the electrospray medium thereat. The nozzle is adapted to be spaced apart from the receiving unit in a longitudinal direction so as to define a traveling path. Preferably, the nozzle is a capillary formed with an outlet that is configured to sequentially form the liquid drops of the electrospray medium thereat. The electrospray unit further includes a pump disposed downstream of the reservoir and upstream of the capillary for drawing the electrospray medium into the capillary. In this embodiment, the nozzle is a capillary that is made from a metal material.

The voltage supplying member is disposed to establish between the capillary and the receiving unit a potential difference which is of an intensity such that the liquid drops are laden with a plurality of charges, and such that the liquid drops are forced to leave the capillary as a multiple-charged one for heading toward the receiving unit along the traveling path.

The laser desorption unit is adapted to irradiate the sample such that, upon irradiation, at least one of the analytes contained in the sample is desorbed to fly along a flying path which intersects the traveling path so as to enable said at least one of the analytes to be occluded in the multiple-charged liquid drops, and such that as a result of dwindling in size of the multiple-charged liquid drops when approaching the receiving unit along the traveling path, charges of the liquid drops will pass on to said at least one of the analytes to form a corresponding one of the ionized analytes.

No limitation is imposed upon the wavelength, energy, and frequency of the laser beam transmitted by the laser desorption unit, as long as the laser beam is capable of desorbing at least one of the analytes from the sample when the latter is irradiated thereby. Preferably, the laser desorption unit includes a laser transmission mechanism that is selected from the group consisting of a nitrogen laser, an argon ion laser, a helium-neon laser, a carbon dioxide ($CO_2$) laser, and a garnet (Nd:YAG) laser. In this embodiment, the laser transmission mechanism is a nitrogen laser.

Optionally, the electrospray unit further includes an airstream supplying mechanism for accelerating vaporization of the liquid portion of the multiple-charged liquid drops that fly between the electrospray unit and the mass analyzer. The airstream supplying mechanism assists in vaporization of the liquid portion by supplying a non-reactive gas. Preferably, the non-reactive gas travels toward the mass analyzer, and has a temperature that falls between the room temperature and 325° C. More preferably, the non-reactive gas is selected from the group consisting of nitrogen gas, helium gas, neon gas, argon gas, and a combination thereof.

The mass spectrometer of the present invention implements the method for mass spectrometry as described hereinabove. In this embodiment, the mass spectrometer includes the above described receiving unit and electrospray-assisted laser desorption ionization device, and a sample stage. The receiving unit includes a mass analyzer having a conduit for receiving and analyzing the ionized analytes derived from the sample, and a detector for detecting signals generated as a result of analyzing the ionized analytes by the mass analyzer.

In order to maintain good directionality of the electric field resulting from the potential difference established between the capillary of the electrospray unit and the mass analyzer during operation of the mass spectrometer so as to ensure successful entrance of the ionized analytes into the mass analyzer, the sample stage is preferably not grounded. In addition, for the purpose of ensuring that most of the laser beam energy is concentrated on the sample, the sample stage is preferably made from a material that is non-transmissive by laser. In this embodiment, the sample stage is made from stainless steel. Moreover, the sample stage can also be designed to be movable so as to facilitate adjustments of the placement of the sample with respect to other components of the mass spectrometer, and to facilitate placement/replacement of the sample thereon.

The mass analyzer receives the ionized analytes through the conduit, separates the ionized analytes according to their m/z values (mass-to-charge ratios), and generates corresponding signals for the ionized analytes. Preferably, the mass analyzer is selected from the group consisting of an ion trap mass analyzer, a quadrupole time-of-flight mass analyzer, a triple quadrupole mass analyzer, an ion trap time-of-flight mass analyzer, a time-of-flight/time-of-flight mass analyzer, and a Fourier transform ion cyclotron resonance (FTICR) mass analyzer. In this embodiment, the mass analyzer is one of an ion trap mass analyzer and a quadrupole time-of-flight mass analyzer.

The detector detects the signals generated as a result of the analysis performed by the mass analyzer, and converts the signals into a mass spectrum. Preferably, the detector 83 is an electron multiplier as illustrated in the embodiments of the present invention.

The relative positions or distances among the various components of the mass spectrometer according to the present invention need to be those such that the following objectives are achieved: at least one of the analytes is desorbed from the sample; and said at least one of the analytes is capable of being occluded in the multiple-charged liquid drops of the electrospray medium such that the charges of the liquid drops are passed on to said at least one of the analytes as a result of dwindling in size of the multiple-charged liquid drops when approaching the mass analyzer along the traveling path to form a corresponding one of the ionized analytes. The ionized analytes move toward the mass analyzer under a potential difference established between the capillary of the electrospray unit and the mass analyzer, and are received by the mass analyzer through the conduit such that subsequent mass spectrometric analysis procedures can be performed. Therefore, each of the components of the mass spectrometer can be designed to be movable such that adjustments of the positions thereof can be made by the user as are required. Similarly, the energy, frequency, incident angle of the laser beam transmitted by the laser desorption unit, and parameters such as composition and flow rate of the electrospray medium in the capillary can be adjusted as required in order to obtain optimal detection results.

The position of the laser desorption unit relative to other components of the mass spectrometer does not have any specific restriction, as long as at least one of the analytes is ensured to be desorbed from the sample. Preferably, the laser desorption unit is configured such that the incident angle of the laser beam on the sample falls between 0 and 90 degrees. More preferably, the incident angle falls between 35 and 55 degrees. In this embodiment, the laser desorption unit is configured such that incident angle is 45 degrees.

Preferably, the electrospray unit and the laser desorption unit are disposed such that central axes of the capillary and the conduit of the mass analyzers are substantially parallel to each other, and such that distance between the central axes of the capillary and the conduit falls between 0.1 mm and 20 mm. In an embodiment of the present invention, this distance is 2 mm.

Preferably, the electrospray unit and the laser desorption unit are disposed such that the central axis of the capillary and the top surface of the sample stage are substantially parallel to each other, and such that distance between the central axis of the capillary and the top surface falls between 0.1 mm and 10 mm. In an embodiment of the present invention, this distance is 3 mm.

Preferably, the electrospray unit and the laser desorption unit are disposed such that the central axis of the capillary and a top surface of the sample stage on which the sample is placed are substantially parallel to each other, and such that distance between projections of the outlet of the capillary and a surface of the sample on a plane parallel to the top surface of the sample stage falls between 0.1 mm and 10 mm. In an embodiment of the present invention, this distance is 2 mm.

Preferably, distance between projections of the outlet of the capillary of the electrospray unit and an opening to the conduit in the mass analyzer on a plane parallel to the top surface of the sample stage falls between 6 mm and 0.1 mm. In an embodiment of the present invention, this distance is 8 mm.

Preferred Embodiments

The present invention is described in greater detail hereinbelow with respect to the preferred embodiments and exemplary applications presented. It should be noted herein that the embodiments and exemplary applications are for illustrative purposes only, and should not be taken as limitations imposed on the present invention.

Chemical and Equipments Used

The preferred embodiments, exemplary methods, and comparison (experiment) cases are conducted using the following chemicals and equipments:

1. Laser Desorption Unit: Pulse Nitrogen Laser model no. VSL-337i, manufactured by Laser, Science Inc. of the United States. The laser beams transmitted by the pulse nitrogen laser have a wavelength of 337 nm, a frequency of 10 Hz, a pulse duration of 4 ns, and a pulse energy of 25 μJ.
2. Mass Analyzer (including the Detector):
   a. Ion Trap Mass Analyzer model no. Esquire Plus 3000, manufactured by Bruker Dalton company of Germany.
   b. Quadrupole Time-of-Flight Mass Analyzer model no. q-TOF, manufactured by Bruker Dalton company of Germany.
3. Electrospray Medium: an aqueous solution containing 0.1 vol % of acetic acid and 50 vol % of methanol. The methanol and acetic acid are HPLC solvents manufactured by Sigma-Aldrich company of the United States.
4. Protein Standard: insulin (molecular weight of 5700), myoglobin (molecular weight of 16951), cytochrome c (molecular weight of 12230), all of which are HPLC protein standards manufactured by Sigma-Aldrich company of the United States.

5. Matrix: α-cyano-4-hydroxycinnamic acid (α —CHC), which is a HPLC matrix manufactured by Sigma-Aldrich company of the United States.
6. Matrix-Assisted Laser Desorption Ionization Mass Spectrometer (MALDI-MS); model no. Autoflex MALDI/TOF, manufactured by Bruker Dalton company of Germany, and suitable for analyzing macromolecules in the linear mode.

Preferred Embodiment

Electrospray-Assisted Laser Desorption Ionization Device

Referring to FIG. 5 and FIG. 6, the first preferred embodiment of an electrospray-assisted laser desorption ionization device 7 according to the present invention is adapted for use in a mass spectrometer. The mass spectrometer includes a receiving unit 8 including an ion trap mass analyzer 81 formed with a conduit 811 that is in air communication with the environment, a sample stage 82 having a top surface 821, and a detector 83 for receiving signals generated by the mass analyzer 81.

Referring to FIGS. 2 to 5, the electrospray-assisted laser desorption ionization device 7 desorbs some of the analytes 41 contained in a sample 4 that is placed on the top surface 821 of the sample stage 82 such that said some of the analytes 41 fly along a flying path (Y). The ionization device 7 also forms multiple-charged liquid drops 51, which, under the potential difference, move toward the mass analyzer 81 along a traveling path (X) that intersects the flying path (Y) such that the analytes 41 flying along the flying path (Y) are occluded in corresponding multiple-charged liquid drops 51. As the multiple-charged liquid drops 51 dwindle in size when approaching the mass analyzer 81 along the traveling path (X), charges of the liquid drops 51 will pass on to the corresponding analytes 41 occluded therein to form corresponding ionized analytes 42. The ionized analytes 42 are then guided by the potential difference to move toward and to be received by the mass analyzer 81 for subsequent mass spectrometric analysis procedures.

As shown in FIG. 5, the electrospray-assisted laser desorption ionization device 7 includes an electrospray unit 71, a voltage supplying member 77, and a laser desorption unit 6.

The electrospray unit 71 includes a reservoir 72 for accommodating a liquid electrospray medium 5, and a nozzle 73 which is disposed downstream of the reservoir 72, and which is configured to sequentially form liquid drops 51 of the electrospray medium 5 thereat. The nozzle 73 is adapted to be spaced apart from the mass analyzer 81 in a longitudinal direction so as to define the traveling path (X). The electrospray unit 73 further includes a pump 74 disposed downstream of the reservoir 72 and upstream of the nozzle 73 for drawing the electrospray medium 5 into the nozzle 73. In this embodiment, the nozzle 73 is a capillary **73*a* formed with an outlet 731 that is configured to sequentially form the liquid drops 51 of the electrospray medium 5 thereat. The capillary 73*a* is made from a metal material, and the outlet 731 has a diameter that is equal to 100 μm and faces toward the conduit 811 of the mass analyzer 81**.

The voltage supplying member 77 is disposed to establish between the capillary **73*a* and the mass analyzer 81 a potential difference which is of an intensity such that the liquid drops 51 are laden with a plurality of charges, and such that the liquid drops 51 are forced to leave the nozzle 73 as multiple-charged ones for heading toward the mass analyzer 81** along the traveling path (X).

The laser desorption unit 6 includes a nitrogen gas laser transmission mechanism 62 that is capable of transmitting a laser beam 61, a lens 63 that is disposed to receive the laser beam 61 from the laser transmission mechanism 62 for focusing the energy carried by the laser beam 61, and a reflector 64 that is disposed to change the path of the laser beam 61.

The laser desorption unit 6 is adapted to irradiate the sample 4 such that, upon irradiation, at least one of the analytes 41 contained in the sample 4 is desorbed to fly along the flying path (Y) which intersects the traveling path (X) so as to enable said at least one of the analytes 41 to be occluded in the multiple-charged liquid drops 51, and such that as a result of dwindling in size of the multiple-charged liquid drops 51 when approaching the mass analyzer 81 along the traveling path (X), charges of the liquid drops 51 will pass on to said at least one of the analytes 411 to form a corresponding one of the ionized analytes 42.

As shown in FIG. 6, when the ionization device 7 cooperates with the mass analyzer 81, the sample stage 82, and the detector 83 to form a mass spectrometer, a first central axis 732 of the capillary **73*a* of the electrospray unit 71 and a second central axis 812 of the conduit 811 in the mass analyzer 81 are substantially parallel to each other. The sample stage 82 extends in the longitudinal direction such that the top surface 821 thereof defines a leveled plane in the longitudinal direction. The entrance 813 into the conduit 811 is offset from the outlet 731 of the capillary 73*a* with respect to the leveled plane. In particular, the shortest distance (D1) between the leveled plane and an entrance 813 into the conduit 811 is greater than the shortest distance (D2) between the leveled plane and the outlet 731 of the capillary 73*a*. The difference (d) between the distances (D1) and (D2) falls between 0.1 mm to 20 mm. In this embodiment, the difference (d) is 2 mm. The first central axis 732 of the capillary 73*a* is substantially parallel to the top surface 821 of the sample stage 82 with the shortest distance (D2) between the two falling between 0.1 mm to 10 mm. In this embodiment, the distance (D3) is approximately equal to 3 mm. Further, the distance (D4) between projections of the outlet 731 of the capillary 73*a* and the entrance 813 into the conduit 811 of the mass analyzer 81** on the leveled plane is approximately 8 mm.

With reference to both FIG. 5 and FIG. 6, when the ionization device 7 is activated, the laser beam 61 transmitted by the laser transmission mechanism 62 has a 45° incident angle with the top surface 821 of the sample stage 82, and forms a laser spot 65 with a 100 μm×150 μm area on a surface of the sample 4 so as to desorb the analytes 41 from the sample 4. Approximately 200 laser pulses are averaged for generating the mass spectrum.

In order for the sample 4 to be movable relative to the laser beam 61, the sample stage 82 is designed to be mobile in this embodiment such that a laser spot 65 is formed at a different location on the surface of the sample for each laser pulse so as to prevent the sample from burning and so as to ensure that a fresh sample area is probed for each laser pulse. Moreover, variations of the incident angle of the laser beam 61 with respect to the surface of the sample 4 can be controlled by the reflector 64. The magnitude (D5) of a projection vector between the outlet 731 of the capillary **73*a* and the laser spot 65 on the surface of the sample 4 onto a plane that is parallel to the top surface 821 of the sample stage 82 falls between 0.1 mm and 10 mm. In this embodiment, the magnitude (D5**) of the projection vector is 2 mm.

In this embodiment, the outlet 731 of the capillary 73*a* is grounded, and the mass analyzer 81 is maintained at a −3.5 kV voltage level so as to establish an electric field therebetween with a field direction pointing from the capillary 73*a* toward the mass analyzer 81. The pump 74 draws the electrospray medium 5 at a flow rate of 150 μL per minute into the capillary 73*a*. As illustrated in FIG. 2 to 4, the multiple-charged liquid drops 51 of the electrospray medium 5 are formed sequentially at the outlet 731 of the capillary 73*a* as the liquid drops 51 are forced out of the capillary 73*a* along the traveling path (X) under the presence of the electric field. As the analytes 41 contained in the sample 4 are desorbed to fly along the flying path (Y), the analytes 41 are occluded in the multiple-charged liquid drops 51. As the multiple-charged liquid drops 51 dwindle in size when moving along the traveling path (X), the charges of the liquid drops 51 will pass on to corresponding analytes 41 to form corresponding ionized analytes 42. Under the electric field, the ionized analytes 42 approach toward the mass analyzer 81, which has a 2 s/scan scanning rate, to be received into the conduit 811 through the entrance 813.

Figure 7:
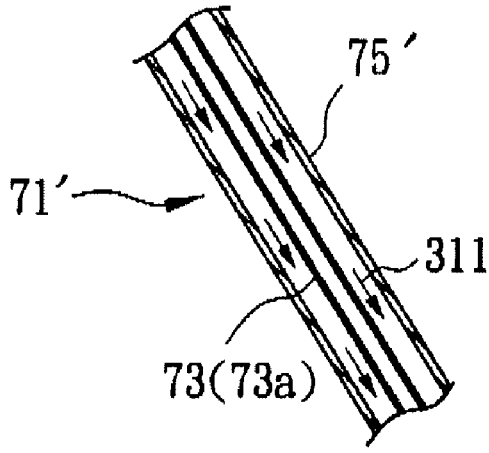
FIG. 7 is a fragmentary sectional view of the second preferred embodiment of an electrospray-assisted laser desorption ionization device according to the present invention, illustrating relative positions of an airstream supplying mechanism and a capillary.

With reference to FIG. 7, the second preferred embodiment of an electrospray-assisted laser desorption ionization device according to the present invention is similar to the first preferred embodiment. The only difference between the first and second preferred embodiments is that the electrospray unit 71' of the second preferred embodiment further includes an airstream supplying mechanism 75' for accelerating vaporization of the multiple-charged liquid drops 51 (refer to FIGS. 2 to 4) to result in dwindling in size thereof when approaching the mass analyzer 81 (refer to FIG. 5) along the traveling path (X). The airstream supplying mechanism 75' surrounds the capillary 73*a*, and supplies a nitrogen airstream 311. In particular, the temperature of the nitrogen airstream 311 can be controlled by the user between the room temperature and 325° C. as is required.

Figure 8:
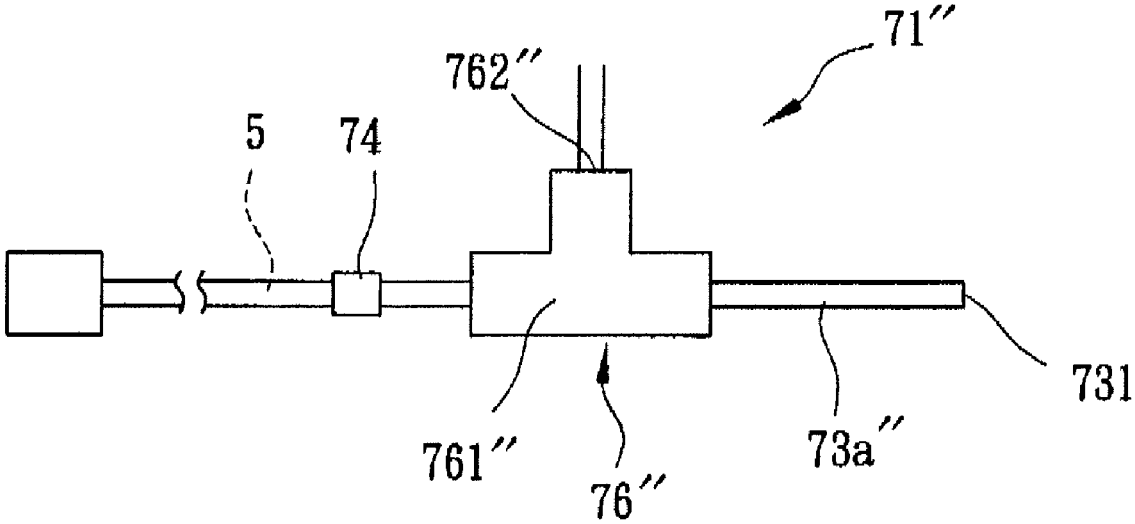
FIG. 8 is a fragmentary sectional view of the third preferred embodiment of an electrospray-assisted laser desorption ionization device according to the present invention, illustrating relative positions of a micro-tube, a capillary, and a pump.

As shown in FIG. 8, the third preferred embodiment of an electrospray-assisted laser desorption ionization device according to the present invention is similar to the first preferred embodiment. The difference between the first and third preferred embodiments is that the electrospray unit 71" of the third preferred embodiment includes a reservoir 72 for accommodating the liquid electrospray medium 5, a capillary 73*a*" that is not made of metal, a pump 74, which is similar to that disclosed in the first preferred embodiment, disposed downstream of the reservoir 72 for drawing the electrospray medium 5 out of the reservoir 72, and a micro-tube 76". The micro-tube 76" includes a tubular body 761" connected between and disposed in fluid communication with the pump 74 and the capillary 73*a*", and a center portion 762" connected to the tubular body 761" and coupled to the voltage supplying member 77 (refer to FIG. 5) such that the potential difference is established between the micro-tube 76" and the mass analyzer 81.

The electrospray-assisted laser desorption ionization device of the present invention can be designed to be replaceable, and can cooperate with amass analyzer and a detector in a mass spectrometer with no specific interface required there among. Various types of mass analyzers, such as ion trap mass analyzers, quadrupole time-of-flight mass analyzers, and triple quadrupole mass analyzers, have been employed by the applicant to couple with the electrospray-assisted laser desorption ionization device of the present invention. Moreover, when the electrospray-assisted laser desorption ionization device according to the present invention is set up with a sample stage and a receiving unit, such as those described in accordance with the first preferred embodiment, an innovative electrospray-assisted laser desorption ionization mass spectrometer (ELDI-MS) of the present invention is assembled.

Exemplary Methods and Comparative Examples

The exemplary methods presented hereinbelow were conducted using an ELDI-MS that combines the first preferred embodiment of the electrospray-assisted laser desorption ionization device and a mass analyzer (including a detector) in the operating modes thereof to perform mass spectrometric analysis in accordance with the present invention.

The comparative examples include those conducted using a matrix-assisted laser desorption ionization mass spectrometer (MALDI-MS). The samples used in the comparative examples were prepared by dehydrating, under atmospheric pressure, protein solutions extracted after homogenizing an operating liquid, and mixing with an α —CHC solution of equal volume and 10 times the concentration. The comparative examples further include those conducted using an electrospray ionization mass spectrometer (ESI-MS) that combines a quadrupole time-of-flight mass analyzer and the electrospray unit of the present invention. The flow rate of the sample solution in the ESI-MS was 150 μL per minute. The ESI-MS conducts mass spectrometric analysis directly on a protein sample solution. If the macromolecules detected by the ELDI-MS of the present invention can also be detected using EST-MS and MALDI-MS, the ELDI-MS of the present invention is confirmed to possess the detection capability as identified in the field.

Categorization of and calculations of the m/z values, electro valence numbers, or molecular weights for individual ion peaks of the mass spectrum acquired by each of the exemplary methods and the comparative examples were conducted using the processing software provided internally in the mass analyzer and the detector. In order to clearly illustrate the results, ion peaks that are not formed by an analyte ionized due to an addition of protons ($H^+$), such as those acquiring charges from $Na^+$ and $K^+$ present in the sample, are not labeled with their corresponding m/z values, electro valence numbers, or molecular weights. Some of the molecular weight values were compared with information found in relevant databases (http://www.swissprot.com or http://www.expasy.ch/sprot) in order to confirm/identify the types of protein. In addition, on account of the electrospray medium being an acidified methanol solution, each of the analytes may be attached with a single proton or multiple protons. Therefore, the following formula can be used to calculate the molecular weight of each of the analytes (such as protein) in each of the ion peaks:

$$m/z=(M+z)/z$$

where M represents the molecular weight of the analyte, z represents the electro valence number attached to the analyte, and (M+z) represents the total mass of the analyte and the protons ($H^+$) attached to the analyte. It should be noted herein that each of the ionized analytes obtained may be a complete protein, or a substance composed of lipid, peptide, and can also be an adduct ion, etc. Since the present invention employs laser for desorption, a protein fragment can be obtained.

The x-axes of all the mass spectrum figures presented herein represent the m/z values. Since relative intensities of each signal peak and corresponding calculated molecular weight values are the basis for interpreting the figures, the y-axis of each of the mass spectrometric analysis figures is either "intensity" or "relative intensity", depending on the operational convenience in each case.

Exemplary Methods 1 to 7—Mass Spectrometric Analysis Conducted on Protein Standard Samples A sample solution for each of exemplary methods 1 to 7 was prepared using a single kind of protein standard or multiple kinds of protein standards mixed together with equal volume (the protein concentration in each of the sample solutions was $10^{-4}$M, and the volume was 2 μL). Each of the sample solutions was dropped on the top surface 821 of the sample stage 82 (as shown in FIG. 5) so as to form a circularly-shaped film of dehydrated substance with a diameter of approximately 2 mm after a natural dehydration process. Subsequently, protein mass spectrometric analysis was conducted using the ELDI-MS according to the present invention. The type of proteins used and the figure number of corresponding mass spectrum for each of the exemplary methods 1 to 7 are tabulated in Table 1 below.

TABLE 1

Figure 9:
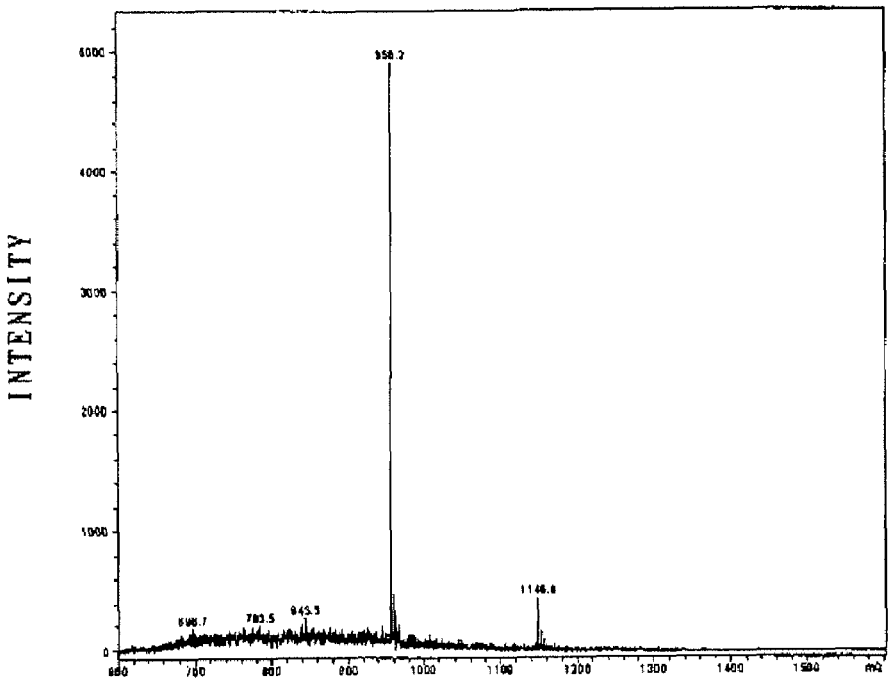
FIG. 9 is a mass spectrum, illustrating an experiment result of exemplary method 1.
Figure 10:
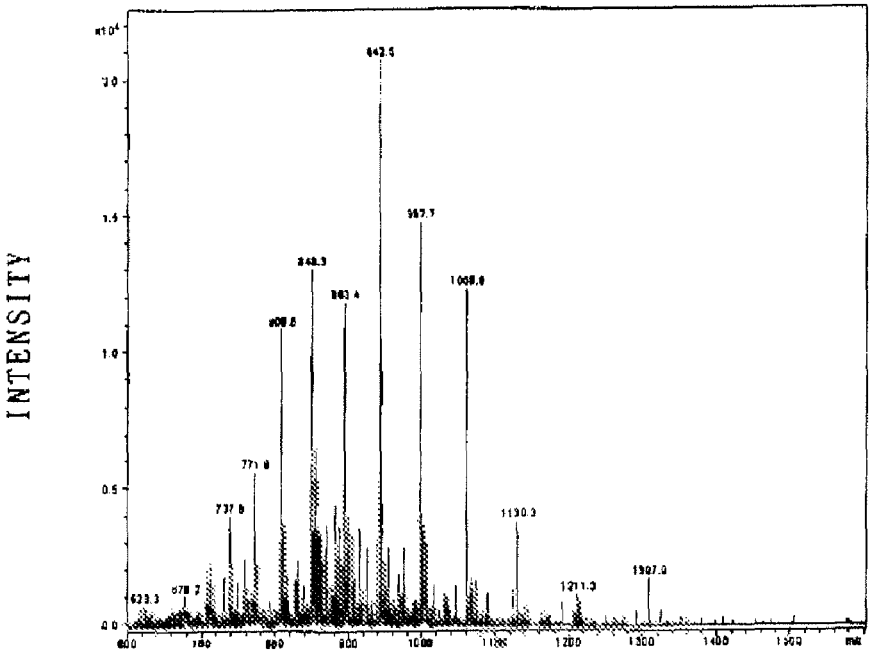
FIG. 10 is a mass spectrum, illustrating an experiment result of exemplary method 2.
Figure 11:
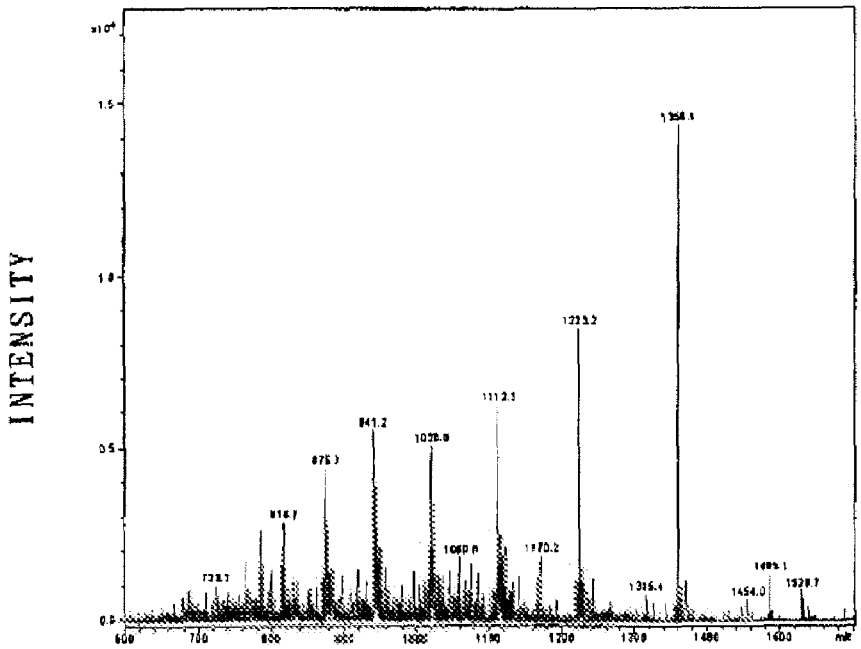
FIG. 11 is amass spectrum, illustrating an experiment result of exemplary method 3.
Figure 12:
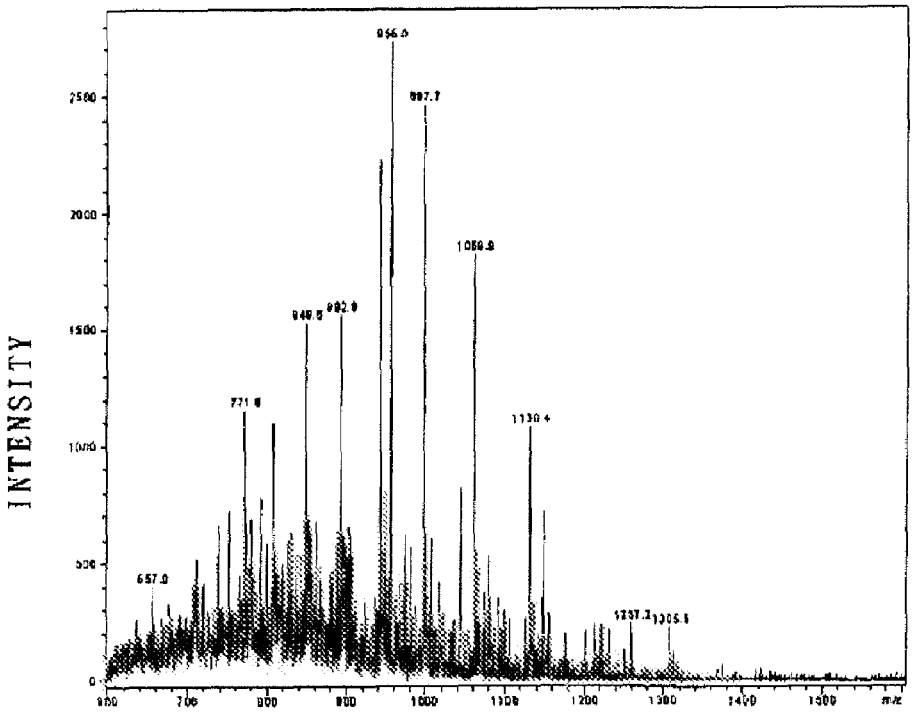
FIG. 12 is a mass spectrum, illustrating an experiment result of exemplary method 4.
Figure 13:
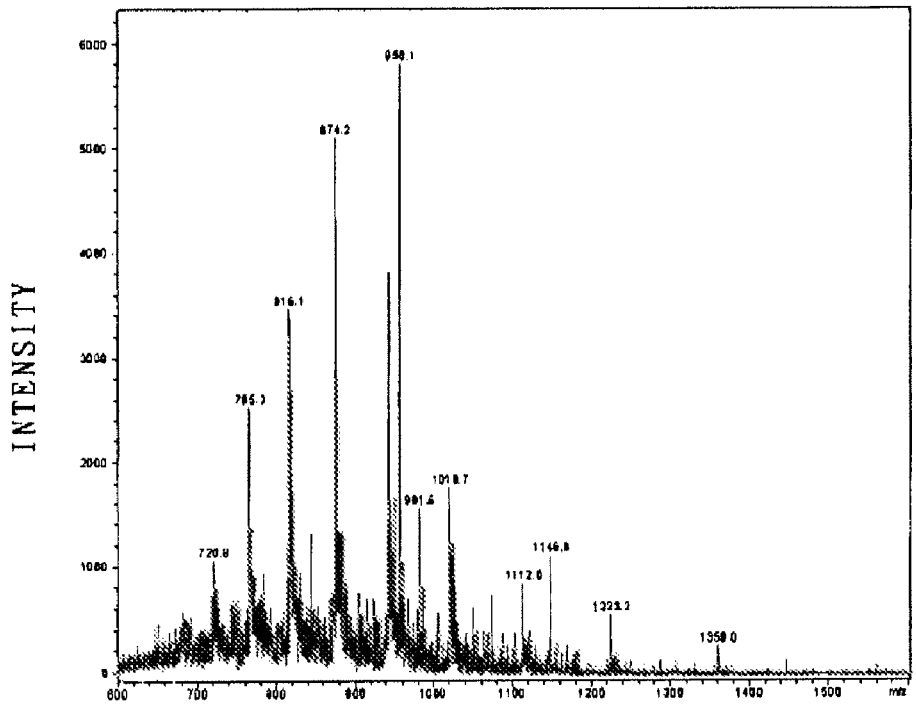
FIG. 13 is amass spectrum, illustrating an experiment result of exemplary method 5.
Figure 14:
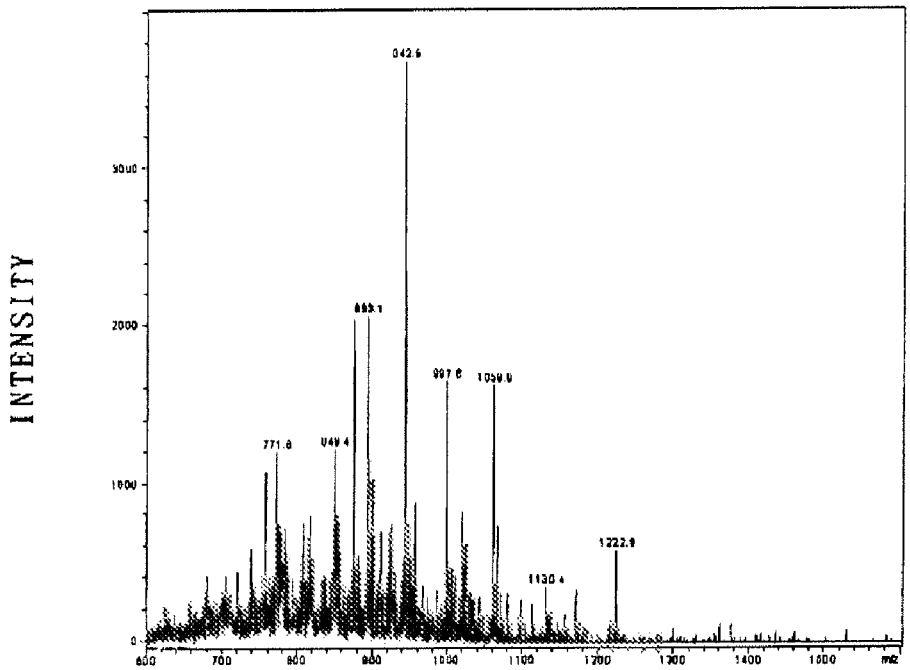
FIG. 14 is a mass spectrum, illustrating an experiment result of exemplary method 6.
Figure 15:
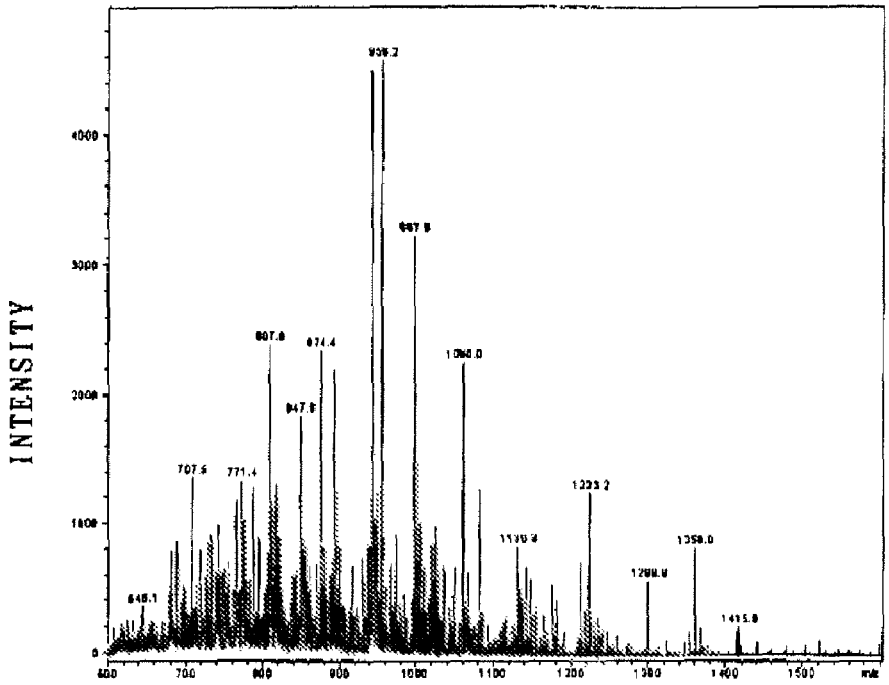
FIG. 15 is amass spectrum, illustrating an experiment result of exemplary method 7.

| | Protein Type | Mass Spectrum |
|---|---|---|
| Exemplary Method 1 | insulin | FIG. 9 |
| Exemplary Method 2 | myoglobin | FIG. 10 |
| Exemplary Method 3 | cytochrome C | FIG. 11 |
| Exemplary Method 4 | insulin + myoglobin | FIG. 12 |
| Exemplary Method 5 | insulin + cytochroine c | FIG. 13 |
| Exemplary Method 6 | myoglobin + cytochrome c | FIG. 14 |
| Exemplary Method 7 | insulin + myoglobin + cytochrome c | FIG. 15 |

Results

The molecular weights of the proteins used in the exemplary methods 1 to 7 were calculated using the previously mentioned formula with the m/z value of each of the ion peaks shown in FIGS. 9 to 15. Then the calculated molecular weights were compared with the known molecular weights for the protein standards provided in the databases. The ion peaks obtained in exemplary method 3 are taken for illustrative purposes hereinbelow in accordance with FIG. 11, where the calculated results match with the molecular weight value of cytochrome c standard, which is 12230, as provided by the manufacturer. The results are tabulated below in Table 2.

TABLE 2

| | Z (electro valence number) | M (molecular weight of analyte) |
|---|---|---|
| m/z = 1359.1 | 9 | 12222.9 |
| m/z = 1223.2 | 10 | 12222.0 |
| m/z = 1112.3 | 11 | 12224.3 |
| m/z = 1020.0 | 12 | 12228.0 |

The same method was used in FIG. 9 and FIG. 10 to obtain matching analysis results for insulin and myoglobin. As for FIGS. 12 to 15, although the samples used were solids dehydrated from heterogeneous (mixed) protein solutions, the mass spectra still show all of the ion peaks resulted from the different kinds of protein standards such that the types of proteins contained in the samples can still be identified. Therefore, the electrospray-assisted laser desorption ionization mass spectrometry technique according to the present invention is confirmed to be capable of conducting mass spectrometric analysis on both homogeneous (single kind of protein standard) and heterogeneous (multiple kinds of protein standards) protein solutions.

Moreover, FIG. 12 and FIG. 13 (exemplary methods 4 and 5) illustrate that almost no ion suppression effect is present in the insulin/myoglobin or insulin/cytochrome c samples. However, FIG. 14 and FIG. 15 (exemplary methods 6 and 7) illustrate that myoglobin suppresses approximately 50% of the cytochrome c signals. Yet the same situation occurred when using an ESI-MS to conduct mass spectrometric analysis on the same samples, the mass spectra of which are not shown in the present application.

Exemplary Methods 8a to 5f—Evaluate the Detection Limit of ELDI-MS using Cytochrome c Standard A sample solution with cytochrome c standard was prepared, and then mass spectrometric analysis was conducted using ELDI-MS, where all the other operating parameters were identical to those used in exemplary methods 1 to 7. The protein concentration and figure number of corresponding mass spectrum for each of the exemplary methods 8a to 8f are tabulated in Table 3 below.

TABLE 3

| | Protein Concentration | Mass Spectrum |
|---|---|---|
| Exemplary Method 8a | $10^{-4}$M | FIG. 16(a) |
| Exemplary Method 8b | $10^{-5}$M | FIG. 16(b) |
| Exemplary Method 8c | $10^{-6}$M | FIG. 16(c) |
| Exemplary Method 8d | $10^{-7}$M | FIG. 16(d) |
| Exemplary Method 8e | $10^{-8}$M | FIG. 16(e) |
| Exemplary Method 8f | $10^{-9}$M | FIG. 16(f) |

Results

Figure 16:
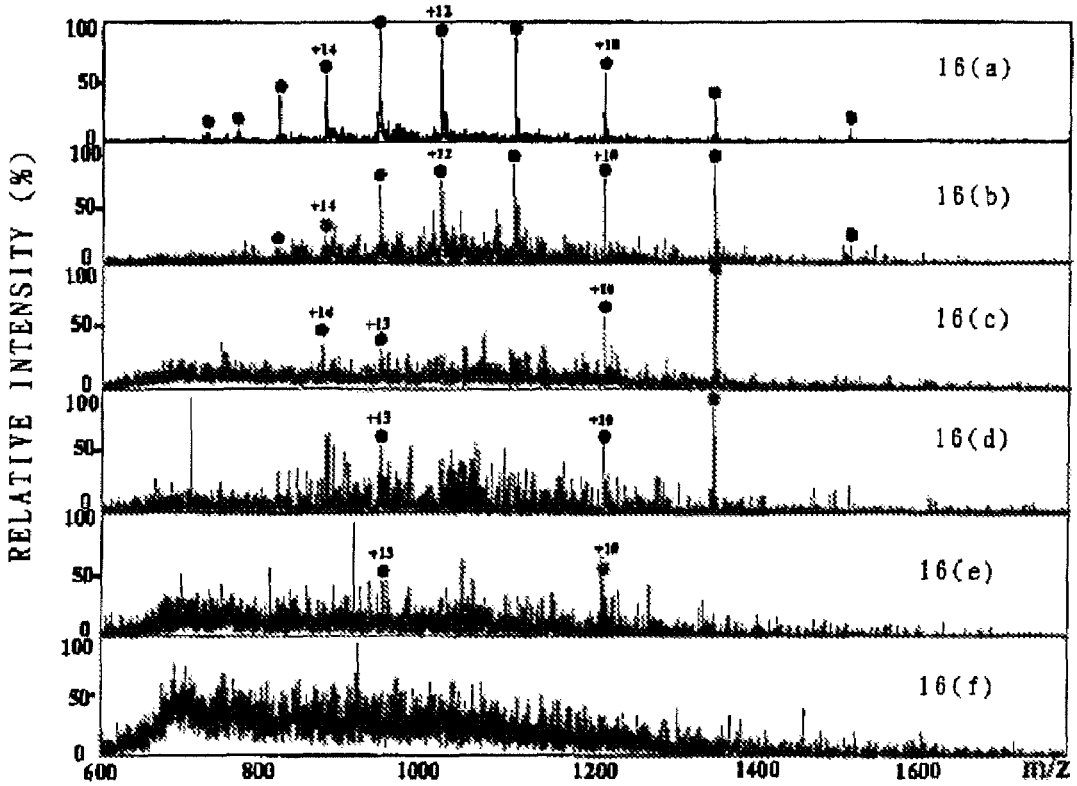
FIG. 16 includes FIGS. 16(*a*) to 16(*f*), each of which is a mass spectrum that illustrates a corresponding experiment result of exemplary methods 8a to 8f.

As can be seen from FIG. 16(*e*), when the concentration of the cytochrome c aqueous solution is $10^{-8}$-M (exemplary method 8e, protein ion peaks formed respectively by ionized analytes having +10 and +13 valence charges can still be obtained. These protein ion peaks were used to derive the molecular weights of the cytochrome c analytes. Therefore, it is found that the detection limit of the ELDI-MS according to the first preferred embodiment of the present invention for liquid samples was $10^{-8}$M, which complies with the standard approved in the field.

The operating conditions of exemplary method 8e are used for illustrative purposes in the following discussion. Since the signals shown in the mass spectrum are averages of the results obtained from various laser pulses, and since the diameter of a laser spot on the sample was approximately 100 μm, while the diameter of the solid sample was approximately 2 mm, with the assumption that the protein molecules contained in the area of the sample at the site of the laser spot were all desorbed and were analyzed according to the ELDI method of the present invention, then the number of protein molecules consumed should be approximately equal to $5\times10^{-7}$ moles. This number seems to be the detection limit of the ELDI-MS of the present invention. As compared to the detection limit of the presently-popular ESI-MS (approximately $10^{-12}$ moles), and MALDI-MS (approximately $10^{-15}$ moles) for protein identification, the ELDI-MS of the present invention is more advantageous.

Exemplary Methods 9a to 9e—Conducting Mass Spectrometric Analysis with Samples Prepared from Dehydrating Various Body Fluids The detection method of exemplary method 1 was used, but with various body fluids (from an individual body's source) as the samples for detection of the macromolecules contained therein. The sample type for each of exemplary methods 9a to 9e is provided hereinbelow in Table 4. After comparing with information provided in the database, the results show that the ELDI-MS of the present invention is indeed capable of detecting several kinds of protein molecules:

TABLE 4

| | Body Fluid Type | Mass Spectra | Calculated Molecular Weight | Result of Molecular Weight Comparison |
|---|---|---|---|---|
| Exemplary Method 9a | Human Blood | FIG. 17(a) | M▲ = 15,128 Da<br>M● = 15,865 Da | M▲ is hemoglobin α chain of mammals |
| Exemplary Method 9b | Rabbit Blood | FIG. 17(b) | M▲ = 15,457 Da<br>M● = 16,001 Da | |
| Exemplary Method 9c | Rat Blood | FIG. 17(c) | M▲ = 15,021 Da<br>M● = 15,631 Da | M● is hemoglobin β chain of mammals |
| Exemplary Method 9d | Human Tear | FIG. 17(d) | 14,682 Da | Lysozyme |
| Exemplary Method 9e | Human Blood Serum | FIG. 17(e) | M● = 66,441 Da<br>M▲ = 31,330 Da<br>M■ = 30,032 Da<br>M★ = 30,344 Da<br>M♥ = 21,350 Da<br>M⊗ = 41,640 Da | M● is albumn |

Figure 17:
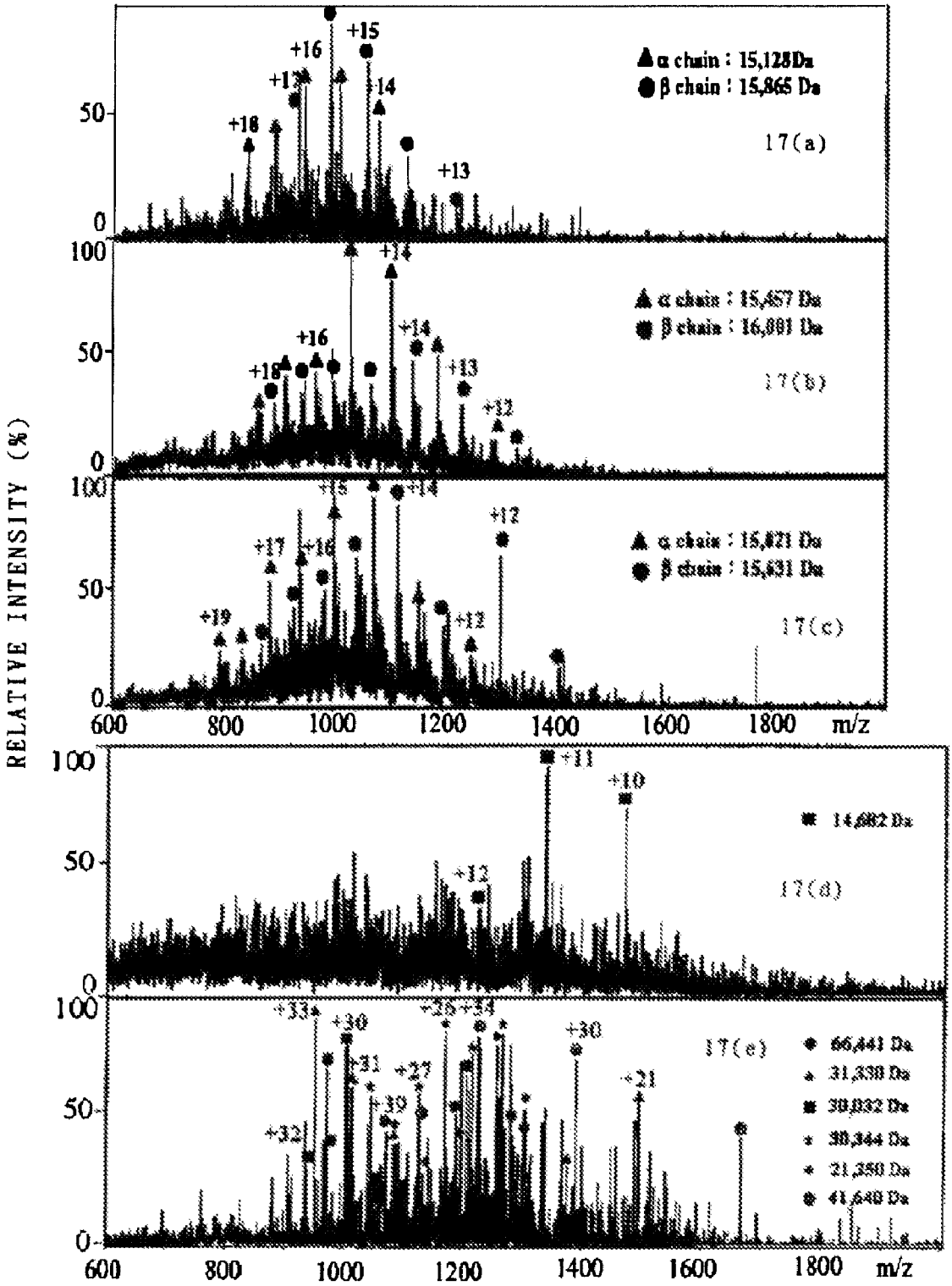
FIG. 17 includes FIGS. 17(*a*) to 17(*e*), each of which is a mass spectrum that illustrates a corresponding experiment result of exemplary methods 9a to 9e.

The ion peaks obtained from each of FIGS. 17(*a*) to 17(*c*) can be categorize into two main groups, and corresponding molecular weights can be obtained after calculations. After comparing with the information provided in the databases, the two proteins are respectively hemoglobin α-chain and β-chain in mammals. The samples used in exemplary methods 9a to 9c were respectively human blood, rabbit blood, and rat blood, where large quantities of hemoglobin are present. This fact is obvious from FIGS. 17(*a*) to 17(*c*). Similarly, it is known that tears (i.e., the sample used in exemplary method 9d) contain lysozyme. The distribution of ion peaks and the result of comparison between the molecular weights calculated and the information in the databases show that lysozyme is the main protein in the sample, which matches with the known fact.

As opposed to blood, blood serum is a sample whose composition is more complicated. As illustrated in the mass spectrum for exemplary method 9e, albumn is detected. Although other analytes with calculated molecular weights cannot be identified due to insufficient information provided in the databases, it is at least proven by FIG. 17(*e*) that the ELDI-MS of the present invention is capable of conducting mass spectrometric analysis directly on a dehydrated sample of a mixed protein solution containing multiple types of proteins to successfully detect proteins.

Exemplary Methods 10a to 10c—Conducting Mass Spectrometric Analysis on Bacterial Culture Samples Vibrio cholern, Salmonella, and Streptococcus bacterial cultures (provided privately) were smeared on the top surface 821 of the sample stage 82 (as shown in FIG. 5) to form a circularly-shaped film of dehydrated sample with a diameter of approximately 2 mm. Then ELDI-MS of the present invention was used to conduct mass spectrometric analysis to determine the molecular weights of proteins contained in the sample. The type of samples used and the results of each of the exemplary methods 10a to 10c are provided hereinbelow in Table 5:

TABLE 5

| | Bacteria Type | Mass Spectra | Calculated Molecular Weight | Protein Name |
|---|---|---|---|---|
| Exemplary Method 10a | *Vibrio cholern* | FIG. 18(a) | M● = 11,091 Da | Hypothetical protein VCA0797 (molecular weight 11,090) |
| Exemplary Method 10b | *Salmonella* | FIG. 18(b) | M♠ = 12,068 Da | Phop regulated (molecular weight 12,072) or SieB protein (fragment, molecular weight 12,064) |
| Exemplary Method 10c | *Streptococcus* | FIG. 18(c) | M★ = 6,482 Da | Copper chaperone (molecular weight 6,481) |

Figure 18:
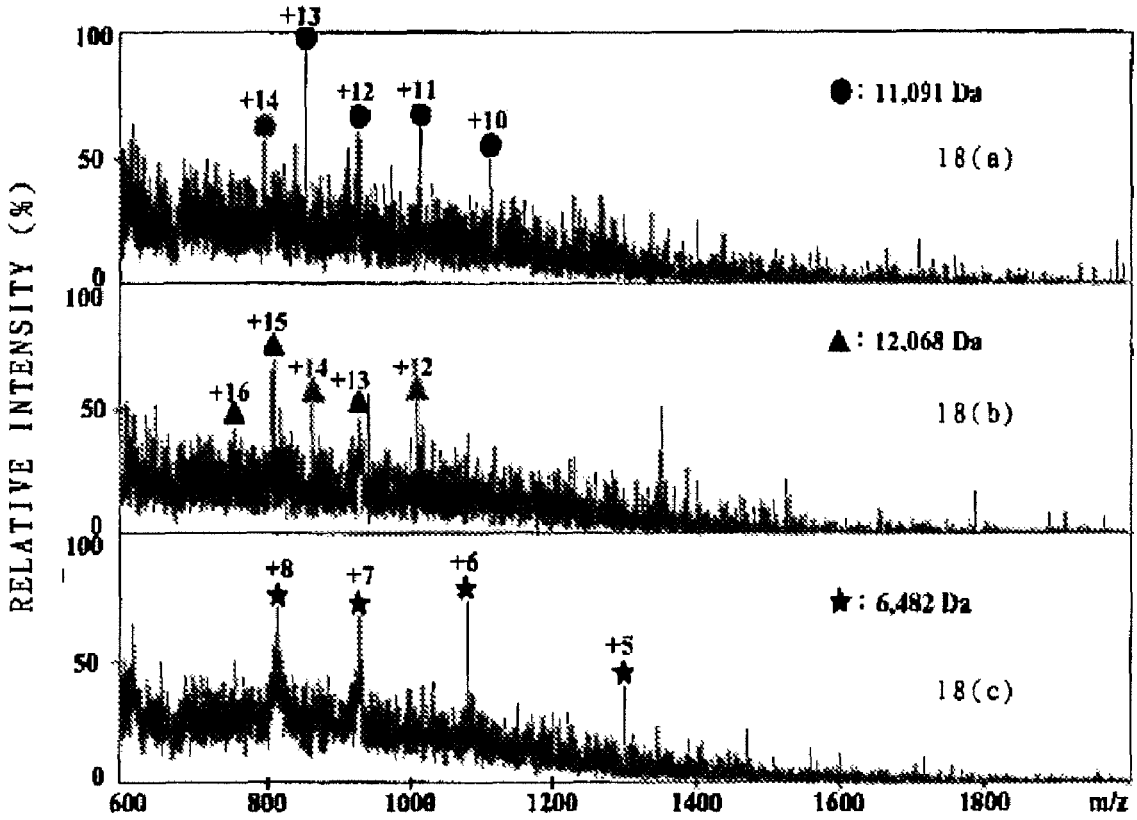
FIG. 18 includes FIGS. 18(*a*) to 18(*c*), each of which is a mass spectrum that illustrates a corresponding experiment result of exemplary methods 10a to 10c.

The calculated molecular weights obtained with respect to FIGS. 18(*a*) to 18(*c*) match with the molecular weights of the protein molecules contained in the bacteria as recorded in the databases. Consequently, it is shown that ELDI-MS of the present invention is capable of conducting mass spectrometric analysis and identifying the proteins contained in a bacterial culture sample.

Exemplary Methods 11a to 11a—Using Various Wet Biological Tissue Section as the Sample, and Conducting Mass Spectrometric Analysis Using ELDI-MS, ESI-MS, and MALDI-MS Parts of a pig (purchased from a wet market in Taiwan), such as the brain, heart, liver, etc., were each cut randomly using a razor into a slice (with a size of approximately 10×2×2 mm), which was then placed on the top surface 821 of the sample stage 82 (as shown in FIG. 5) as the sample. For each type of sample, mass spectrometric analyses were conducted using ELDI-MS (with a quadrupole time-of-flight mass analyzer), an ESI-MS and a MALDI-MS known in the art, respectively. The type of samples used and the results for each of the exemplary methods 11a to 11c and for each of the comparative examples 1 to 6 are provided hereinbelow in Table 6. Those macromolecules detected using ELDI-MS that were also detected using ESI-MS and MALDI-MS are underlined.

It should be understood first that different results may be obtained due to differences in sample preparation for conducting the three different methods of mass spectrometry:

TABLE 6

Figure 19:
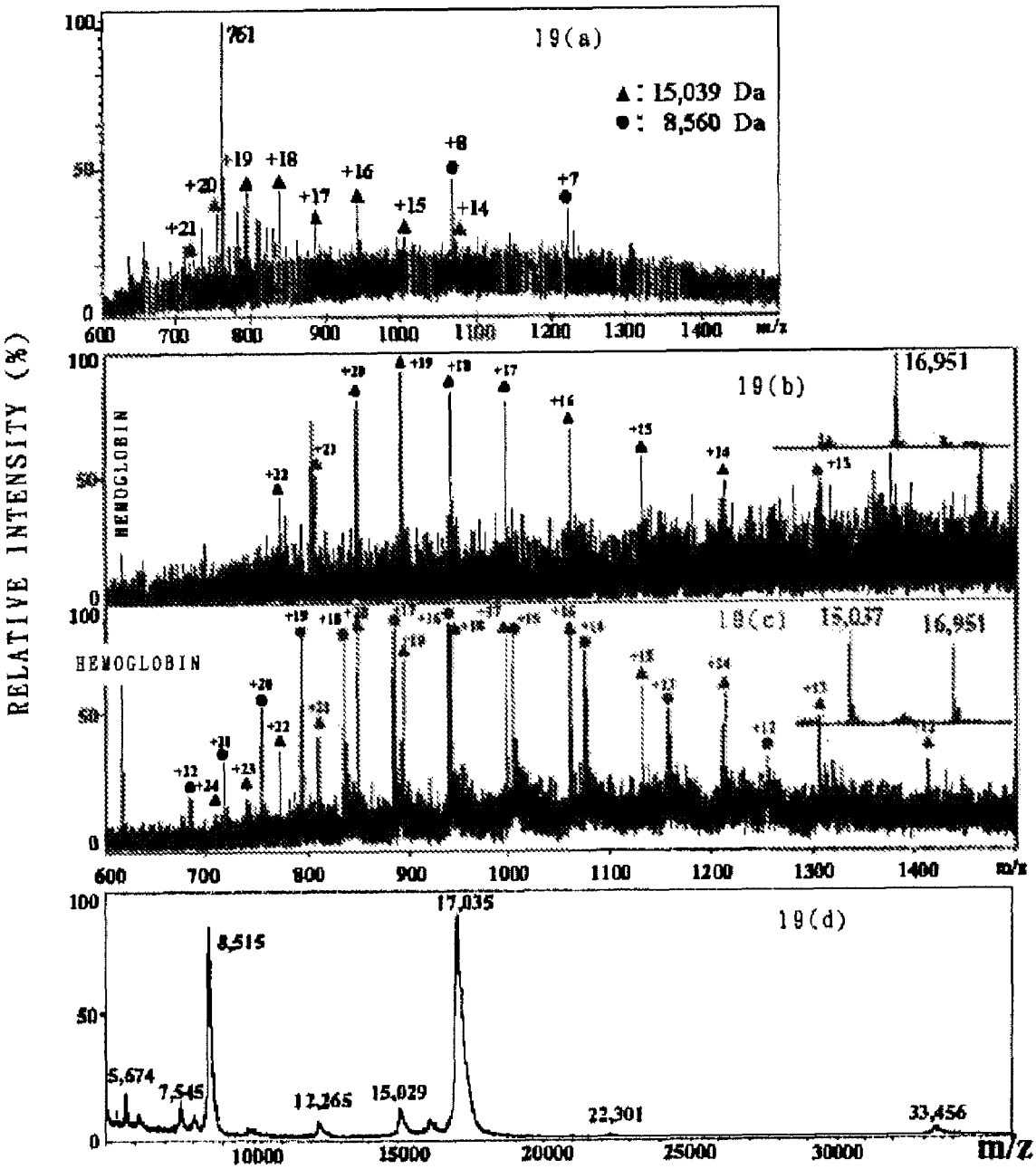
FIG. 19 includes FIGS. 19(*a*) to 19(*d*), each of which is a mass spectrum that illustrates a corresponding experiment result of exemplary methods 11a and 11b, and comparative examples 3 and 4.

| | Source | Method of Analysis | Mass Spectra | Calculated Molecular Weight |
|---|---|---|---|---|
| Method 11a | Pig | ELDI-MS | FIG. 19(a) | <u>15,039 Da</u>, 8,560 Da |
| Comparative example 1 | Brain | ESI-MS | Not shown | <u>15,037 Da</u> |
| Comparative example 2 | | MALDI-MS | | 8,455 Da, 9,833 Da |
| Method 11b | Pig | ELDI-MS | FIG. 19(b) | <u>Hemoglobin, M = 16,951Da</u> |
| Comparative example 3 | Heart | ESI-MS | FIG. 19(c) | <u>Hemoglobin; M = 16,951 Da</u>, 15,951 Da |

TABLE 6-continued

Figure 20:
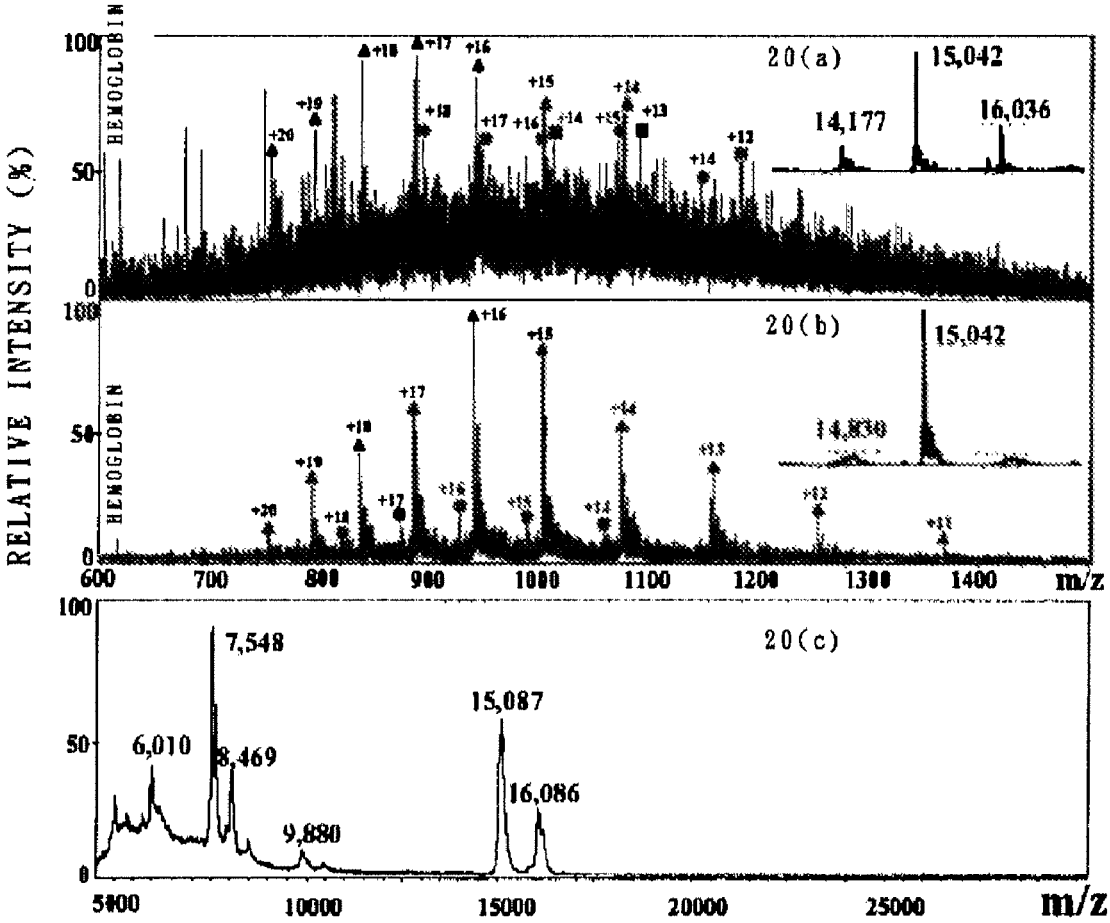
FIG. 20 includes FIGS. 20(*a*) to 20(*c*), each of which is a mass spectrum that illustrates a corresponding experiment result of exemplary method 11c, and comparative examples 5 and 6.

| | Source | Method of Analysis | Mass Spectra | Calculated Molecular Weight |
|---|---|---|---|---|
| Comparative example 4 | | MALDI-MS | FIG. 19(d) | Albumn: M = 33,456 Da, 22,301 Da, 16,024Da; M = 5,674 Da, 7,545 Da, 8,515 Da, 12,265 Da, 15,029 Da, 17,035 Da |
| Method 11c | Pig Liver | ELDI-MS | FIG. 20(a) | Hemoglobin, M = 15,042 Da; M = 14,177 Da, 16,036 Da |
| Comparative example 5 | | ESI-MS | FIG. 20(b) | Hemoglobin, M = 15,042 Da; M = 14,830 Da |
| Comparative example 6 | | MALDI-MS | FIG. 20(c) | M = 6,010 Da, 7,548 Da, 8,469 Da, 9,880 Da, 15,087 Da, 16,086 Da |

As can be seen from Table 6, the ELDI-MS of the present invention is capable of conducting mass spectrometric analysis on various kinds of tissue sections and can successfully detect macromolecules including proteins, such as hemoglobin, contained in the tissue sections. At the same time, the results using ELDI-MS as listed in Table 6 also show that the macromolecules detected using ELDI-MS of the present invention directly from various kinds of tissue sections were also detected using ESI-MS and MALDI-MS. Thus, the ELDI-MS is demonstrated to be feasible in applying directly on various kinds of tissue sections for analysis.

Furthermore, in accordance with the results for exemplary methods 11b and 11c, it can be found that high reconstruction capability can still be obtained even after conducting mass spectrometric analysis directly on complicated "unprocessed" solid samples (i.e., solid samples without any pre-analysis preparations), such as tissue sections. In addition, in accordance with FIG. 19(*b*) and FIG. 19(*d*), and FIG. 20(*a*) and FIG. 20(*c*), it can be seen that the resolution of ELDI-MS is much higher than that of a linear MALDI-MS, which is generally accepted to be suitable for detection of macromolecules.

Exemplary Method 12—Conducting ELDI-MS Analysis on Tablet Samples

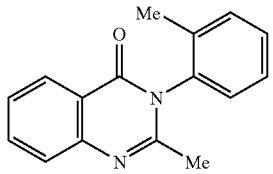

Figure 21:
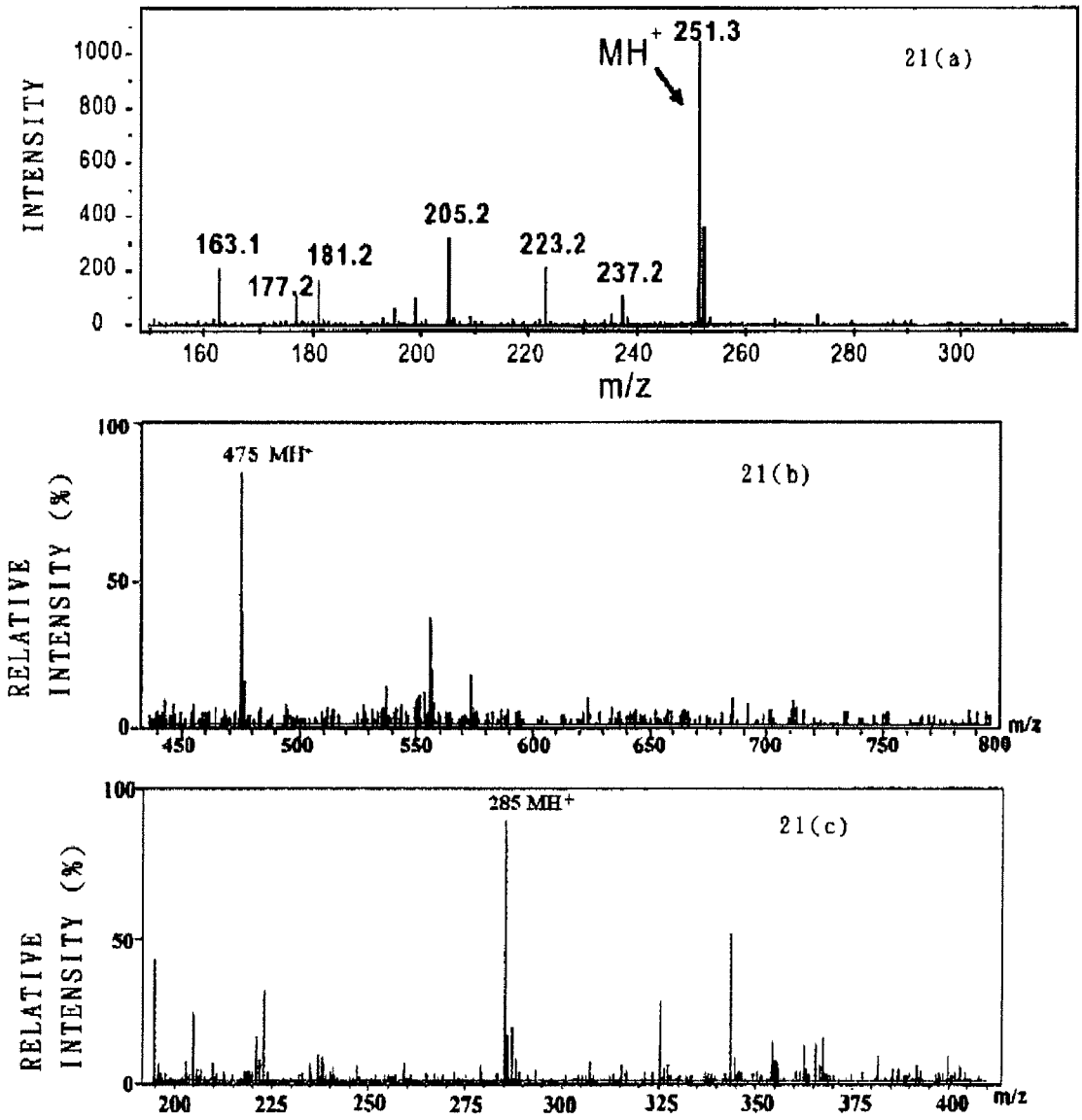
FIG. 21 includes FIGS. 21(*a*) to 21(*c*), each of which is a mass spectrum that illustrates a corresponding experiment result of exemplary methods 12a, 12b, and 12c.

A tablet (size 1 $cm^{2\times0.4}$ cm, provided privately) containing methaqualone (2-methyl-3-(2-methylphenyl)-4 (3H)-quinazolinone), as shown in the figure above, was taken as the sample for exemplary method 12a; a Viagera tablet (manufactured by Pfizer Pharmaceutical Company of the United States) was taken as the sample for exemplary method 12b; and another tablet with unknown composition (provided privately) was used as the sample for exemplary method 12c for conducting mass spectrometric analysis. The results of the mass spectrometric analysis for exemplary methods 12a to 12c are shown respectively in FIGS. 21(*a*) to 21(*c*). Ion peak of each of methaqualone, Sildenafil (one of the compositions of the Viagera pill), and diazepam (m/z values=251.3, 475, and 285, respectively) is obtained in a corresponding mass spectrum. In addition, these ion peaks are each the ion peak with the highest intensity in the corresponding mass spectrum. Thus, from the mass spectra, it is shown that these chemical compounds are the main ingredients in the corresponding tablets. Therefore, ELDI-MS can conduct mass spectrometric analysis directly on a tablet, the result of which is compared with additional information (such as other analytic results) or information provided in databases to quickly identify the composition of the medicine, thereby being advantageous in drug identification in criminal judgment.

With reference to the results described hereinabove with respect to the exemplary methods and comparative examples, it can be shown that the present invention has the following effects and advantages:

1. Capable of conducting analysis directly on a solid sample to obtain complete qualitative information about the analytes:

It is evident from the results of the exemplary methods that the electrospray-assisted laser desorption ionization mass spectrometry of the present invention has the ability to detect the molecular weights of macromolecules (e.g., proteins) contained in an "unprocessed" solid sample (i.e., a solid sample without any pre-analysis preparations). In other words, it is not required to conduct pre-analysis preparation on sampling, such as adding a matrix or extracting proteins, etc., in order for the samples to be suitable for analysis by the present invention. Being able to conduct the analysis directly on an "unprocessed" solid sample not only simplifies the operating procedure, but also saves time and cost significantly. In addition, highly accurate and highly precise results are obtained from the analysis in a relatively short period of time.

2. Easy to operate, low equipment cost:

Since the electrospray-assisted laser desorption ionization device according to the present invention is capable of performing ionization procedures under atmospheric pressure, and since vacuum or other special interfaces (conditions) are not necessary for proper operation of the electrospray-assisted laser desorption ionization device, the same can cooperate directly with various kinds of mass analyzers and detectors to form a mass spectrometer. Therefore, manufacturing cost of related equipments is significantly lower than other mass spectrometers operating under vacuum conditions.

The electrospray-assisted laser desorption ionization device according to the present invention can also be designed to be replaceable such that a user can replace the ionization device of a presently existing mass spectrometer with the electrospray-assisted laser desorption ionization device of the present invention in order to transform the presently existing mass spectrometer into one employing electrospray-assisted laser desorption ionization mass spectrometry according to the present invention. This replaceable feature allows the user to quickly get a grasp of the operation of electrospray-assisted laser desorption ionization mass spectrometry so as to perform fast and precise mass spectrometric analysis.

3. Capable of obtaining spatial analysis information on proteins contained in organs and tissues:

The present invention utilizes the laser desorption unit to transmit a laser beam and to form a laser spot on the sample. This is helpful in identifying macromolecules (e.g., proteins) contained in a particular point on tissue sections with convenience, speed, and high resolution, thereby generating spatial distribution profile of proteins on a particular point in an organ or a tissue by integrating all the results. This is advantageous to future development in medical and related fields, and to the diagnosis of diseases.

In sum, not only are the electrospray-assisted laser desorption ionization device, the mass spectrometer employing electrospray-assisted laser desorption ionization technique, and the method for mass spectrometry incorporating electrospray-assisted laser desorption ionization according to the present invention capable of conducting mass spectrometric analysis directly on a small quantity of "unprocessed" samples, but they are capable of successfully detecting macromolecules such as proteins, so that the same can be used as a protein identification tool. In addition, because of the simple operational procedures involved, extremely low detection limit, and lack of special operating conditions of the electrospray-assisted laser desorption ionization device, the same can be used directly with various kinds of mass analyzers. These effects combine to show that the present invention can be applied to various fields, is especially advantageous in qualitative analysis of macromolecules in proteomics, and is also beneficial to basic medical science with respect to the understanding of the spatial distribution of proteins in various organs and tissues. Furthermore, the present invention is also applicable to the study and analysis of various body fluids and micro-molecules, such as medication, the analytic results of which is of considerable value in criminal judgment.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. An electrospray-assisted laser desorption ionization device adapted for use in a mass spectrometer which includes a receiving unit disposed to admit therein ionized analytes that are derived from a sample, and that are to be analyzed by the mass spectrometer, said electrospray-assisted laser desorption ionization device comprising:

an electrospray unit including a reservoir for accommodating a liquid electrospray medium, and a nozzle which is disposed downstream of said reservoir, and which is configured to sequentially form liquid drops of said electrospray medium thereat, said nozzle being adapted to be spaced apart from the receiving unit in a longitudinal direction so as to define a traveling path;

a voltage supplying member disposed to establish between said nozzle and the receiving unit a potential difference which is of an intensity such that the liquid drops are laden with a plurality of charges, and such that the liquid drops are forced to leave said nozzle as multiple-charged ones for heading toward the receiving unit along the traveling path; and a laser desorption unit adapted to irradiate the sample such that, upon irradiation, at least one of the analytes contained in the sample is desorbed to fly along a flying path which intersects the traveling path so as to enable said at least one of the analytes to be occluded in the multiple-charged liquid drops, and such that as a result of dwindling in size of the multiple-charged liquid drops when approaching the receiving unit along the traveling path, charges of the liquid drops will pass on to said at least one of the analytes occluded therein to form a corresponding one of the ionized analytes.

2. The electrospray-assisted laser desorption ionization device as claimed in claim 1, wherein said nozzle of said electrospray unit is a capillary formed with an outlet that is configured to sequentially form the liquid drops of said electrospray medium thereat, said electrospray unit further including a pump disposed downstream of said reservoir and upstream of said capillary for drawing said electrospray medium into said capillary, wherein said capillary is made from a metal material.

3. The electrospray-assisted laser desorption ionization device as claimed in claim 1, wherein said nozzle of said electrospray unit is a capillary formed with an outlet that is configured to sequentially form the liquid drops of said electrospray medium thereat, said electrospray unit further including a pump disposed downstream of said reservoir for drawing said electrospray medium out of said reservoir, and a micro-tube that has a tubular body connected between and disposed in fluid communication with said pump and said capillary, and a center portion connected to said tubular body and coupled to said voltage supplying member such that the potential difference is established between said micro-tube and the receiving unit.

4. The electrospray-assisted laser desorption ionization device as claimed in claim 1, wherein said laser desorption unit includes a laser transmission mechanism selected from the group consisting of a nitrogen laser, an argon ion laser, a helium-neon laser, a carbon dioxide laser, and a garnet laser.

5. The electrospray-assisted laser desorption ionization device as claimed in claim 4, wherein said laser transmission mechanism is a nitrogen laser.

6. The electrospray-assisted laser desorption ionization device as claimed in claim 4, wherein said electrospray unit further includes an airstream supplying mechanism for accelerating vaporization of the multiple-charged liquid drops to result in dwindling in size thereof when approaching the receiving unit along the traveling path.

7. The electrospray-assisted laser desorption ionization device as claimed in claim 1, wherein the sample is a solid sample.

8. The electrospray-assisted laser desorption ionization device as claimed in claim 1, wherein the analytes contained in the sample include protein molecules.

9. A mass spectrometer, comprising:

a receiving unit disposed to admit therein ionized analytes that are derived from a sample, and that are to be analyzed by the mass spectrometer; and an electrospray-assisted laser desorption ionization device including:

an electrospray unit including a reservoir for accommodating a liquid electrospray medium, and a nozzle which is disposed downstream of said reservoir, and which is configured to sequentially form liquid drops of said electrospray medium thereat, said nozzle being spaced apart from said receiving unit in a longitudinal direction so as to define a traveling path;

a voltage supplying member disposed to establish between said nozzle and said receiving unit a potential difference which is of an intensity such that the liquid drops are laden with a plurality of charges, and such that the liquid drops are forced to leave said nozzle as multiple-charged ones for heading toward said receiving unit along the traveling path; and a laser desorption unit adapted to irradiate the sample such that, upon irradiation, at least one of the analytes contained in the sample is desorbed to fly along a flying path which intersects the traveling path so as to enable said at least one of the analytes to be occluded in the multiple-charged liquid drops, and such that as a result of dwindling in size of the multiple-charged liquid drops when approaching said receiving unit along the traveling path, charges of the liquid drops will pass on to said at least one of the analytes occluded therein to form a corresponding one of the ionized analytes.

10. The mass spectrometer as claimed in claim 9, further comprising a sample stage having a top surface on which the sample is placed; and wherein said receiving unit includes a mass analyzer having a conduit for receiving and analyzing the ionized analytes derived from the sample, and a detector for detecting signals generated as a result of analyzing the ionized analytes by said mass analyzer.

11. The mass spectrometer as claimed in claim 10, wherein said sample stage is made from a material that is non-transmissible by laser.

12. The mass spectrometer as claimed in claim 10, wherein said nozzle of said electrospray unit of said electrospray-assisted laser desorption ionization device is a capillary having an outlet that is configured to sequentially form the liquid drops of said electrospray medium thereat.

13. The mass spectrometer as claimed in claim 12, wherein said sample stage extends in the longitudinal direction such that said top surface of said sample stage defines a leveled plane in the longitudinal direction, shortest distance between the leveled plane and an entrance into said conduit in said mass analyzer being greater than that between the leveled plane and said outlet of said capillary.

14. The mass spectrometer as claimed in claim 9, wherein the sample is a solid sample.

15. The mass spectrometer as claimed in claim 9, wherein the analytes contained in the sample include protein molecules.

16. A method for mass spectrometry, comprising the steps of:

placing a sample containing a plurality of analytes on a sample stage;

providing an electrospray unit that includes a reservoir for accommodating a liquid electrospray medium, and a nozzle disposed downstream of the reservoir and configured to sequentially form liquid drops of the electrospray medium thereat;

providing a mass analyzer that is spaced apart from the nozzle of the electrospray unit in a longitudinal direction so as to define a traveling path for receiving and analyzing ionized analytes derived from the sample;

providing a detector for detecting signals generated as a result of analyzing the ionized analytes by the mass analyzer, and for generating amass spectrum based on the signals;

establishing a potential difference between the nozzle of the electrospray unit and the mass analyzer, the potential difference being of an intensity such that the liquid drops are laden with a plurality of charges, and such that the liquid drops are forced to leave the nozzle as multiple-charged ones for heading toward the receiving unit along the traveling path;

irradiating the sample with a laser beam such that, upon irradiation, at least one of the analytes contained in the sample is desorbed to fly along a flying path which intersects the traveling path so as to enable said at least one of the analytes to be occluded in the multiple-charged liquid drops, and such that as a result of dwindling in size of the multiple-charged liquid drops when approaching the receiving unit along the traveling path, charges of the liquid drops will pass on to said at least one of the analytes occluded therein to form a corresponding one of the ionized analytes.

17. The method as claimed in claim 16, wherein the sample is a solid sample.

18. The method as claimed in claim 16, wherein the analytes contained in the sample include protein molecules.

* * * * *